US005732771A

United States Patent [19]

Moore

[11] Patent Number: 5,732,771

[45] Date of Patent: Mar. 31, 1998

[54] PROTECTIVE SHEATH FOR PROTECTING AND SEPARATING A PLURALITY OF INSULATED CABLE CONDUCTORS FOR AN UNDERGROUND WELL

[76] Inventor: Boyd B. Moore, 427 Mignon, Houston, Tex. 77024

[21] Appl. No.: 602,951

[22] Filed: Feb. 16, 1996

Related U.S. Application Data

[60] Division of Ser. No. 448,575, Aug. 7, 1995, Pat. No. 5,667,008, which is a continuation-in-part of Ser. No. 651, 633, Feb. 6, 1991, Pat. No. 5,289,882.

[51] Int. Cl.[6] ..... E21B 33/10; H01R 4/00

[52] U.S. Cl. ..... 166/65.1; 174/71 R

[58] Field of Search ..... 166/65.1; 439/584, 439/587, 278, 281, 282, 583, 588, 623, 936, 445, 449; 174/84 R, 93, 71 R, 71 C, 72 R, 85

[56] References Cited

U.S. PATENT DOCUMENTS

| | | |
|---|---|---|
| 598,109 | 1/1898 | Osgood et al. . |
| 701,208 | 5/1902 | Luke . |
| 1,718,817 | 6/1929 | Greene . |
| 3,285,629 | 11/1966 | Cullen et al. . |
| 3,364,303 | 1/1968 | Zaleski . |
| 3,437,149 | 4/1969 | Cugini et al. . |
| 3,638,732 | 2/1972 | Huntsinger et al. . |
| 3,692,922 | 9/1972 | Sugimoto et al. . |
| 3,739,073 | 6/1973 | Schneider et al. . |
| 3,781,456 | 12/1973 | Knowles et al. . |
| 4,090,565 | 5/1978 | McGee . |
| 4,117,287 | 9/1978 | Walker et al. . |
| 4,154,302 | 5/1979 | Cugini . |
| 4,200,297 | 4/1980 | Tricon . |
| 4,289,199 | 9/1981 | McGee . |
| 4,416,495 | 11/1983 | Regan . |
| 4,583,804 | 4/1986 | Thompson . |
| 4,583,811 | 4/1986 | McMills . |
| 4,614,392 | 9/1986 | Moore . |
| 4,627,489 | 12/1986 | Reed . |
| 4,627,490 | 12/1986 | Moore . |
| 4,708,201 | 11/1987 | Reed . |

FOREIGN PATENT DOCUMENTS

| | | |
|---|---|---|
| 0065113 | 4/1982 | European Pat. Off. . |
| 953 443 | 11/1956 | Germany . |

OTHER PUBLICATIONS

Mark W. Earley et al., The National Electrical Code Handbook, Fifth Edition, pp. 686–689.

*Primary Examiner*—Hoang C. Dang

*Attorney, Agent, or Firm*—Pravel, Hewitt, Kimball & Krieger

[57] ABSTRACT

A protective sheath for protecting and separating a plurality of insulated conductors from a single cable includes a layer of protective armor surronding all of the conductors extending from down hole along production tubing in an underground well. The protective armor terminates at a separating point of the cable conductors so that the plurality of cable conductors are separated into individual cable conductors. The sheath includes a hollow tube for enclosing the plurality of insulated cable conductors and protective armor. A plurality of individual tubes are formed integrally with and endose one end of the rigid tube so that each one of the plurality of cable conductors is routed into a separate rigid tube so that each one of the plurality of rigid tubes encloses a corresponding one of the individual cable conductors. The rigid tube and individual rigid tubes are sized to confine but not engage the conductors when the well is pressurized for preventing excessive expansion of the insulation on the conductors on the well depressurization.

4 Claims, 13 Drawing Sheets

FIG. 16
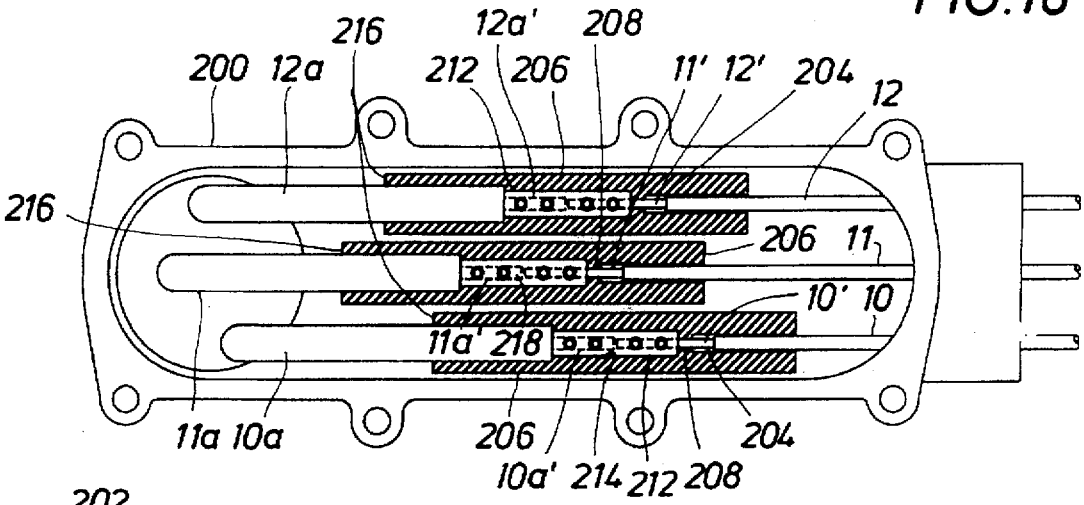
FIG. 17
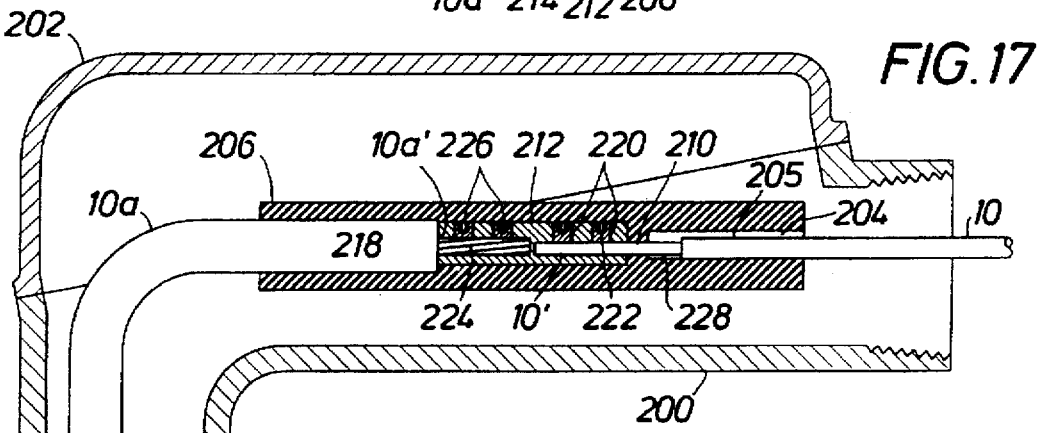
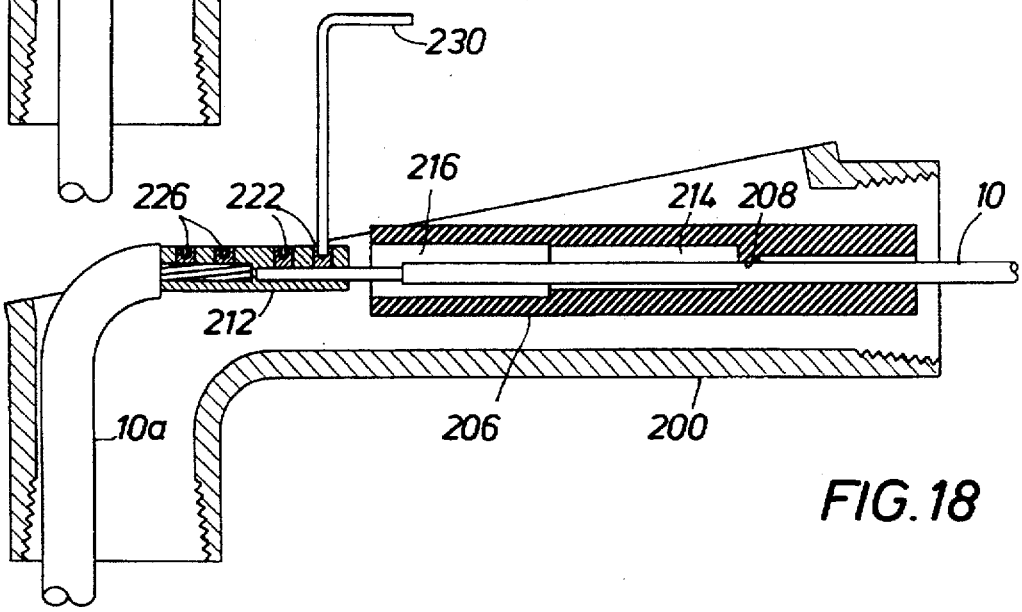
FIG. 18

PROTECTIVE SHEATH FOR PROTECTING AND SEPARATING A PLURALITY OF INSULATED CABLE CONDUCTORS FOR AN UNDERGROUND WELL

This is a divisional, of application Ser. No. 08/448,575, filed Aug. 7, 1995, now the U.S. Pat. No. 5,667,008, which is a CIP of application Ser. No. 07/651,633 filed Feb. 6, 1991 now the U.S. Pat. No. 5,289,882.

STATEMENT OF THE PRIOR ART

Substantial difficulty has heretofore been encountered in providing a sealed arrangement for supplying electrical power to a sealed wellhead over a petroleum producing well bore in a hazardous area where explosions or fires may occur due to gases and other substances associated with the production of petroleum products being ignited by electric arcs. Also, personnel and the general public are subject to electrical shock or death by electrocution.

So far as known to applicant, there has not heretofore been provided a satisfactory and safe method and arrangement for supplying electrical power through power source electrical conductor means to electrical conductor means extending through a sealed barrier associated with a wellhead associated with a well bore in a hazardous area to overcome the above and other problems.

Present commonly employed electrical installations for supplying electrical power through the wellhead and into the well bore for various purposes typically consist of a flexible corrugated electrical conductor means extending through the wellhead which are connected externally of the well bore with the power source electrical conductor means. It is substantially difficult, if not impossible, to initiate and/or maintain an effective seal with the corrugated cable as it passes through the wellhead to prevent discharge of fluids in the hazardous area. The internal elements of the electrical cable are also subject to transmitting well bore liquids and gases therethrough. The gases and liquids pass through the electrical conductor means to an electrical enclosure in an adjacent non-hazardous area which creates another hazardous area. Arcing in the enclosure can cause an explosive situation. From this point, the power source electrical conductor means continues from ground level to the level of the power transformer. Such outdoor electrical installation is not in compliance with commonly accepted electrical practices and requirements, whether such installations occur in a hazardous or in a non-hazardous location.

Designs previously and currently in use fail to overcome the problems presented by the above installations. Both previous and current products employ the use of an attachment plug and receptacle, which constitutes a means by which the device being powered can be disconnected while power continues to be supplied to the power source electrical conductor means. The attachment plug and receptacle constitutes disconnecting means which requires that the attachment plug and receptacle be rated for the same horsepower as the device to which power is being supplied. So far as known to applicant, no such rating is possible, especially since such plug and receptacle should also be capable of withstanding an internal explosion without spreading such explosion.

Inside the wellhead barrier, it is desirable to provide connectors to connect the power conductors to the pump cables from a down hole pump. These connectors allow easy removal in case the well is pulled. However, problems have arisen where the connectors have been disconnected and/or damaged due to changes in pressure when the pump is turned on or off. It is known that the insulation surrounding conductors and the rubber typically used for insulation boots are permeable to fluids, such as gas and other liquids in the well bore. Pressurized and fluid impregnated rubber tends to fill gaps and exposed seams causing paths for fluid to escape to undesired areas. A well is typically pressurized due to pressures exerted by the formation, and can reach pressures at the wellhead in excess of 5,000 to 10,000 pounds per square inch (psi) while the down hole pump is turned off. Such high pressure forces fluids to saturate any gas permeable materials such as rubber and insulation, which would then leak to the conductors and reach external areas where well fluids are undesired via the conductors causing a hazardous situation.

For example, in my previous U.S. Pat. No. 4,614,392, it was disclosed how to seal electrical conductors passing through a packer within separate steel tubes to provide conduction from a low pressure area above the packer to a high pressure area below the packer. Steel tubes were inserted through a penetrator of the packer, where the steel tubes were terminated on either side of the packer using the power cable connectors disclosed. An insulator stand off was provided to electrically isolate a connector socket used to terminate the conductor and the steel tube. It has been discovered, however, that well fluids tend to penetrate the rubber boots surrounding the connector elements and reach the conductive wire, thereby penetrating the insulator stand off. The fluid slowly escapes to the low pressure area via the conductors. It is desired, therefore, to provide a more effective fluid seal, so that connectors placed in down hole pressurized areas will not leak fluids to the low pressure area.

It has also been discovered that prior connectors tended to separate when the fluid-impregnated rubber boots are suddenly depressurized. Depressurization occurs when the down hole pump is shut off causing a pressure differential between the fluid-impregnated boots and the depressurized area surrounding the connector, since the rubber boots are unable to release the fluids fast enough. Thus, the rubber boots tended to expand, forcing apart the mating counterparts of the connector causing disconnection. An external protective shield was provided to protect the rubber and prevent outward expansion, where the outward shield itself composed two mating parts for allowing the connection to be disconnected. Even if the two parts of the protective shield were fastened or otherwise locked together, the pressurized fluid within the rubber caused a piston effect, forcing the electrical connection apart due to the pressure differential. It is therefore desirable to provide a connector capable of remaining intact during pressurization and depressurization within the well.

The power is typically supplied using three separate conductors preferably conducting three phase current. The wellhead generally comprises ferromagnetic tubing spools and tube hangers to achieve the necessary strength without undue cost. To meet § 300-20 of the National Electric Code (NEC), which concerns induced currents in metal enclosures, the three conductors carrying alternating three phase current are typically grouped together to avoid heating the surrounding ferromagnetic metal by induction. A single conductor carrying alternating current causes alternating magnetic flux, which induces electrical eddy currents generating heat in the surrounding ferromagnetic material. Grouping the conductors together in a triangular fashion results in cancellation of a significant amount of the magnetic flux, thereby reducing the electrical eddy currents and heat by induction. However, grouping the conductors also creates a larger hole more than twice the diameter of a single hole, causing an increased radial profile penetrating the wellhead. A single large hole is more difficult to seal than several smaller holes. More significantly, a single large hole forces an off-centered, or eccentric, main pipe through the wellhead, usually resulting in a wellhead having a larger diameter. There is a significant increase in cost associated with an increase in wellhead diameter.

For example, certain discrete wellhead sizes are manufactured, where the typical cost between one wellhead size and the next larger size is approximately $10,000. It is desirable, therefore, to separate the conductors to reduce the radial profile of the electrical connection. Separate conductors are only allowed under NEC § 300-20 if slots are cut in the surrounding metal, or if the conductors are passed through an insulating wall sufficiently large for all of the conductors. Neither of these alternatives are practical or desirable for use in wellheads. Slots would eliminate the necessary seal, and an insulating wall so described is not feasible and would also compromise seal integrity.

SUMMARY OF THE PRESENT INVENTION

An object of the present invention is to overcome the problems presented by prior devices and electrical arrangements used in hazardous areas.

An object of the present invention is to provide a relatively simple method and arrangement for supplying electrical power through power source electrical conductor means and connecting such electrical conductor means with the electrical conductor means associated with a wellhead in a hazardous area for supplying electrical power into a well bore for various purposes, by way of example only, such as a down hole electrical pump, instruments and other down hole equipment.

Another object of the invention is to provide a splicing and conduit arrangement which safely conducts power to electrical conductor means extending through a sealed barrier in a sealed wellhead that is positioned in a hazardous area subject to explosions and fires.

Another object of the present invention is to provide a rigid conduit including a splice fitting whereby a splice may be formed which separates the electrical conductor means of a well bore power cable from the power source electrical conductor means and seal means in the rigid conduit means between the splice fitting and the rigid conduit with breather vent means so as to inhibit the passage of fluids from the electrical conductor means to the power source electrical conductor means.

Another object of the present invention is to provide an arrangement for securing a power source electrical conductor means adjacent a wellhead for supplying power to electrical conductor means that extend into a sealed barrier associated with the wellhead which inhibits explosions and fires in the hazardous area.

A further object of the present invention is to provide an arrangement for supplying electrical power from a power source electrical conductor means in a rigid conduit which may be secured adjacent the wellhead and which is arranged so that the rigid conduit and electrical conductor means therein may be disconnected from the wellhead and removed from the wellhead outside the hazardous area.

A connector within the well is provided, which includes an outer shell attached to a top stop and a bottom stop confining rubber boots surrounding the electrical connection. During depressurization near the wellhead when the down hole pump is turned on or the casing annulus pressure is bled off, the rubber boots are prevented from expanding due to the outer shell and top and bottom stops, so that the connection remains intact.

The conductors pass through the wellhead through rigid tubes and into corresponding connectors according to the present invention. The conductor extends beyond the rigid tube and is terminated with a first connector means, such as a female connector socket, which is adapted to electrically engage a second conductor means, such as a corresponding male connection pin. A stand off is provided around the conductor between the rigid tube and the first connector means to prevent electrical conduction to the rigid tube. The standoff includes an extension lip counter bored to tightly fit around the rigid tube, and an internal shoulder abutting the end of the rigid tube. In this manner, the stand off is forced against the rigid tube forming an effective fluid seal.

The conductors providing three-phase current penetrating the wellhead are aligned to achieve a narrower radial profile than that previously possible. The conductors are preferably arranged side-by-side, although not limited to this configuration, along an arc of a circle having its center the same as the center of the wellhead. Each conductor is surrounded by a rigid tube comprising a non-ferromagnetic, electrically conductive material, where the rigid tube acts as an eddy current shunt for electrical eddy currents induced by the magnetic fields generated by the alternating current flowing through the conductors. In this manner, electrical eddy currents do not flow in the wellhead, which would otherwise consume valuable energy and create undesired heat.

A rigid seal means sealably secures the rigid tubes penetrating the wellhead to protect the conductors. A ferrule-type fitting is provided on the outside of the barrier or wellhead, which includes a ferrule according to the present invention allowing the fitting to be removed without destroying the rigid tubes. The ferrule comprises a resilient material, such as, but not limited to, hard plastic rated for high temperature, and more preferably a polyimide resin. The ferrule is softer than the rigid tube so that it does not permanently bite into the rigid tube. Thus, the ferrule is not permanently attached to the rigid tube, and may be readily removed when the well is pulled.

A protective metal sheath according to the present invention protects the insulation of the down hole cable conductors in the well and provides axial column strength for the conductors. The triskelion surrounds and protects the insulation of the cable conductors by preventing sudden expansion during decompression when the down hole pump is turned on, or when the casing annulus pressure is bled off, where the insulation would otherwise expand and possibly break causing electrical failure. The triskelion is axially fixed in position to the production tubing to provide the column strength. The triskelion also provides a protective transition between a single 3-wire cable extending from down hole to three single wire conduits.

An alternative form of splice fitting includes a breather boot with a breather passage sealed with silicone compound to protect the electrical connection between the power electrical conductor and the electrical conductor extending through the wellhead barrier from water or moisture. The breather passage extends into the breather boot to the exposed conductor wire of the electrical conductor extending through the wellhead barrier. Thus, if the seal in the wellhead barrier should fail allowing well fluids to reach the splice fitting via the electrical conductor, the silicone compound is displaced with the well fluids at a lower pressure than the pressure required to reach the power electrical conductor. Thus allows the well fluids to escape the breather boot into the splice fitting. Thus, the well fluids are prevented from reaching a non-hazardous area via the power electrical conductor.

Other objects and advantages of the present invention will become more readily apparent from a consideration of the following description and drawings.

BRIEF DESCRIPTION OF THE DRAWINGS

FIG. 16 is a top plan view of another form of a splice fitting according to the present invention, with the cover removed, for connecting a power source electrical conductor means with a electrical conductor means in a hazardous area where the present invention is employed;

FIG. 17 is a sectional side view showing a splice completed in the splice fitting of FIG. 16 with a cover thereon;

FIG. 18 is a sectional side view similar to FIG. 17, with the cap or cover of the splice fitting removed, to illustrate the position of the splice before it is completed and positioned as illustrated in FIGS. 16 and 17;

DESCRIPTION OF THE PREFERRED EMBODIMENT

Figure 3:
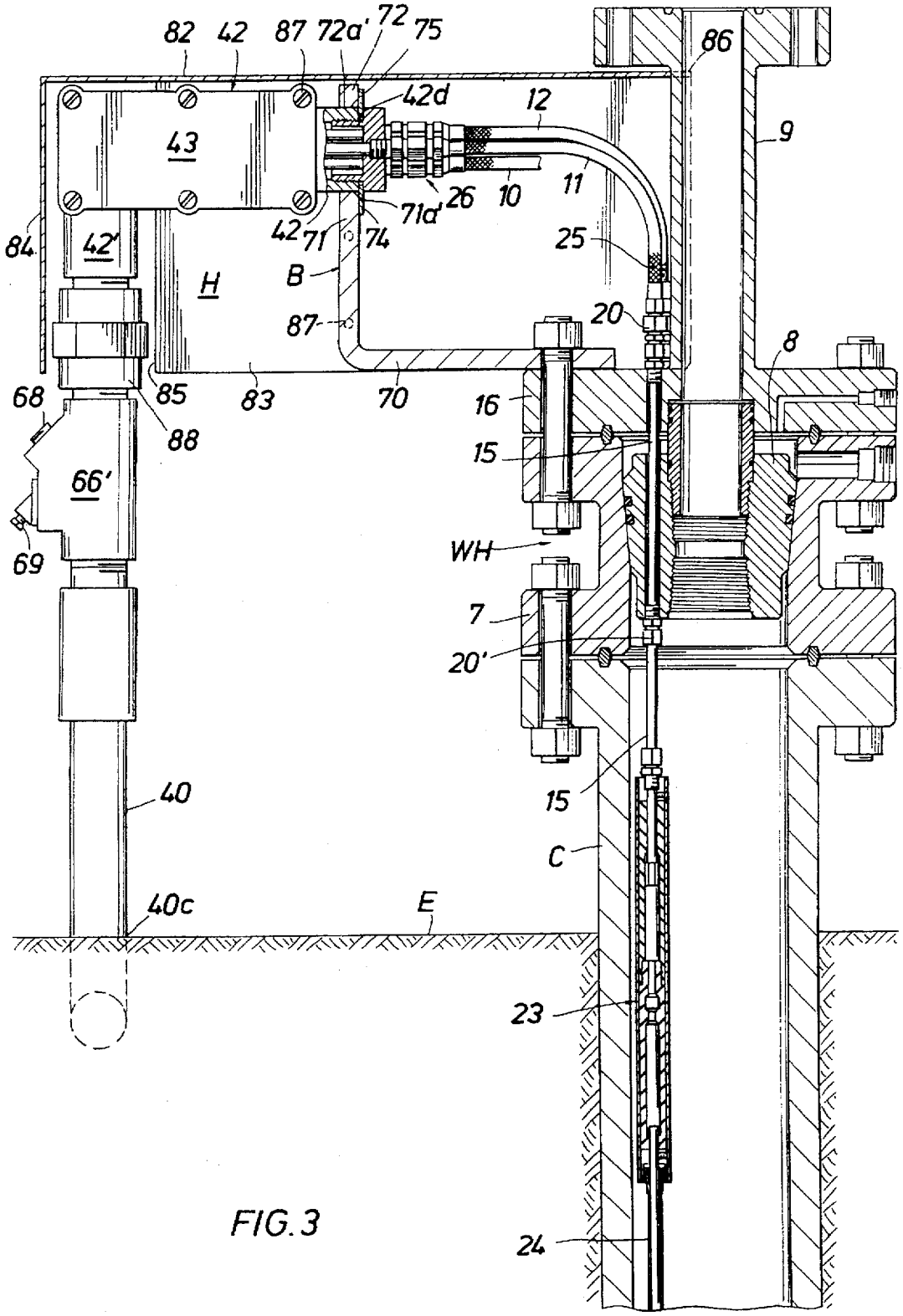
FIG. 3 is a sectional side view partly in elevation on the line 3—3 of FIG. 1.

Attention is first directed to FIG. 3 of the drawings wherein a wellhead arrangement is referred to generally by the letters WH. Wellheads may assume various forms and configurations but generally include some type of member such as by way of example a tubing spool 7 secured by suitable means such as bolts as shown to the casing C which projects upward from the earth E which creates a hazardous area. A tubing hanger 8 may be positioned within the bore of the tubing spool 7 as shown in the drawings for supporting a tubing (not shown) which extends downwardly into the well bore through which the well fluids are conducted from the producing formation(s) in the well bore to the earth's surface. An adapter spool 9 is illustrated as positioned on top of the tubing spool and is adapted to receive a master control valve (not shown) on the top thereof for use in a manner well known in the art.

It can be appreciated that the wellhead configuration and components may change from that illustrated in FIG. 3 which is given by way of example only. Regardless of the configuration and components of a wellhead, the present invention may be employed to connect power source electrical conductor means with electrical conductor means which sealably extends through the wellhead.

The tubing hanger forms a barrier in the wellhead through which electrical conductor means must extend for connection with an external power source to supply power as may be desired to an instrument, down hole pump or other device.

The power source electrical conductor means and the electrical conductor means may be of any well known type, such as by way of example only, each may comprise multiple separate electrical conductors where each electrical conductor is insulated and all the multiple electrical conductors enclosed or encased in a sheath or outer protective jacket. The power source and electrical conductor means may each consist of a single conductor in a sheath or other protective cover.

The present invention will be described in detail as employing separate multiple electrical conductor means, but as noted this is by way of example only.

As illustrated in FIG. 3, the electrical conductor means for a well bore cable is shown as having separate electrical conductor means 10, 11 and 12. As shown in FIG. 3, these separate electrical conductor means extend through the tubing hanger, and each is enclosed within a separate rigid tube means each of which tube means may be designated 15 which rigid tube means sealably extends through the tubing hanger and the lower annular flange 16 of adapter spool 9 which forms one type of sealed barrier for the wellhead WH.

Each of the rigid tube means 15 is preferably formed of material considered to be non-ferromagnetic such as by way of example only stainless steel, which is resistant to attack by fluids in the well bore or in the surrounding hazardous zone. Each tube means 15 is sealably secured by suitable rigid seal means 20, 20' in the wellhead. The rigid seal means 20', 26 may be any suitable well known rigid seal means such as Swagelok® or the like which are available over the counter and which are corrosive resistant and considered to be non-ferromagnetic may be employed.

Upper rigid seal means designated 20 sealably secures said rigid tube means 15 with the flange 16 and also sealably secure one end of the conduit portion 25 with the wellhead WH and/or the rigid tube means 15. Rigid seal means 26 secure the other end of the conduit portion 25 with the splice fitting 42. Additional or lower rigid seal means 20' sealably secures the rigid tube means 15 in the tubing hanger 8 and preferably adjacent the lower end thereof, but this position may be changed, if desired.

Figure 7:
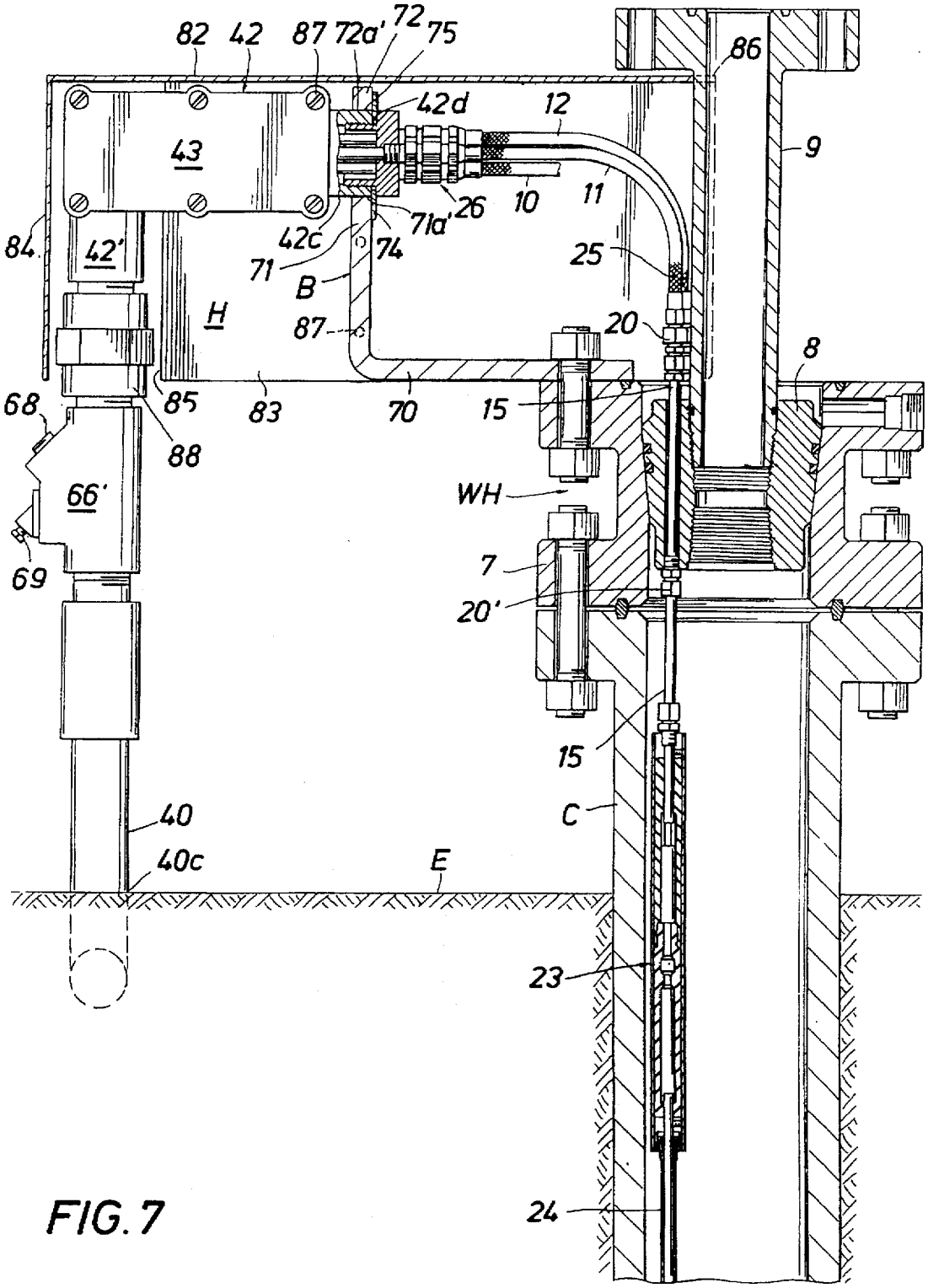
FIG. 7 is a view similar to FIG. 6 showing an alternate form barrier for the wellhead.

The barrier is illustrated in FIG. 3 as comprising the tubing hanger 8 and flange 16. It may be varied by the way of example, to comprise only the tubing hanger 8 or flange 16.

Where the barrier in the wellhead consists of only the tubing hanger 8 as shown in FIG. 7, a single rigid seal means may be employed under some conditions to secure rigid tube means 15 with the hanger 8 but it is preferred that the upper and lower rigid seal means 20, 20' each be positioned as shown in FIG. 7 to sealably secure said rigid tube means 15 with the hanger.

Should the annular flange 16 be employed as the barrier then the rigid seal means 20 may be connected at a single location to sealably secure the rigid tube means 15 passing therethrough, or to same double rigid seal means 20, 20' arrangement described above when the tubing hanger serves as the barrier may be employed to sealably secure with the flange 15 and the rigid tube means 15. It can be appreciated that the location of the rigid seal means 20, 20' in any situation may be varied to accomplish the desired sealing effect with the hanger 8 and/or the flange 16.

Regardless of the form of barrier, the conduit portion 25 is sealably secured therewith as described above.

In the embodiment illustrated in FIG. 3, the electrical conductor means 10, 11, 12 are each further protected by the rigid tubes 15 which surround each of the electrical conductor means from the sealing tube fitting 20' at the lower end of the tubing hanger 8 and each rigid tube means extends to a separate connector represented generally by the numeral 23 wherein the three down hole separate electrical conductor means of the well bore power cable are each connected with one of the separate connectors 23. Suitable protection means such as flexible or rigid tube means forming conductor extensions 24 separately surround each of the electrical conductor means and depend or extend downwardly in the well bore to terminate adjacent the protective jacket on the power cable which jacket receives and encloses all three electrical conductor means therein. The rigid means 20', 26 employed provide a metal to metal seal between the components.

It can be appreciated that the wellhead and tubing hanger are provided with suitable seals as illustrated in FIG. 3 for inhibiting the flow of fluid therefrom in a undesired manner.

Where the electrical conductor means comprise separate insulated electrical conductor means 10, 11, 12 as shown in FIG. 3 each may be received in a separate conduit portion 25, which as previously noted, is sealably secured at one end by the rigid seal means 20 to the wellhead WH and at its other end by the rigid seal means 26. Where the electrical conductor means consists of a plurality of separate insulated electrical conductor means enclosed in a sheath or a single electrical conductor means in a sheath which extends through the wellhead, then there is only a single conduit portion 25 sealably secured adjacent the barrier and adjacent splice fitting 42 by rigid seal means 26. The rigid means 26 is preferably a swivel nut Swagelok® fitting to enable the arrangement of the present invention to be more readily disconnected from the wellhead as will be described herein. The conduit portion(s) 25 may be flexible or rigid of any suitable type to withstand the conditions under which they will be employed and to safely supply the power from the power source electrical conductor means to the electrical conductor means of the power cable extending downwardly in the well bore (not shown). The conduit portion(s) 25 should be capable of withstanding a minimum of 600 psi internal test pressure and are preferably formed of Monel 400 which is considered to be non-ferromagnetic and which will withstand the corrosive conditions to which the flexible electrical conduits may be subjected. Any other suitable flexible or rigid material which is corrosive resistant and considered non-ferromagnetic and capable of withstanding 600 psi internal test pressure may be used. The conduit portion(s) may be obtained from any suitable source and is an over the counter type of the product with one form including a metal internal bellows surrounded by wire braid. The rigid seal means 26 which connects the flexible conduits and the single electrical conductor in each of said flexible conduits may be of any suitable type available on the market such as Swagelok® as previously noted. The rigid seal means 20 is described more fully below.

Figures 1, 2:
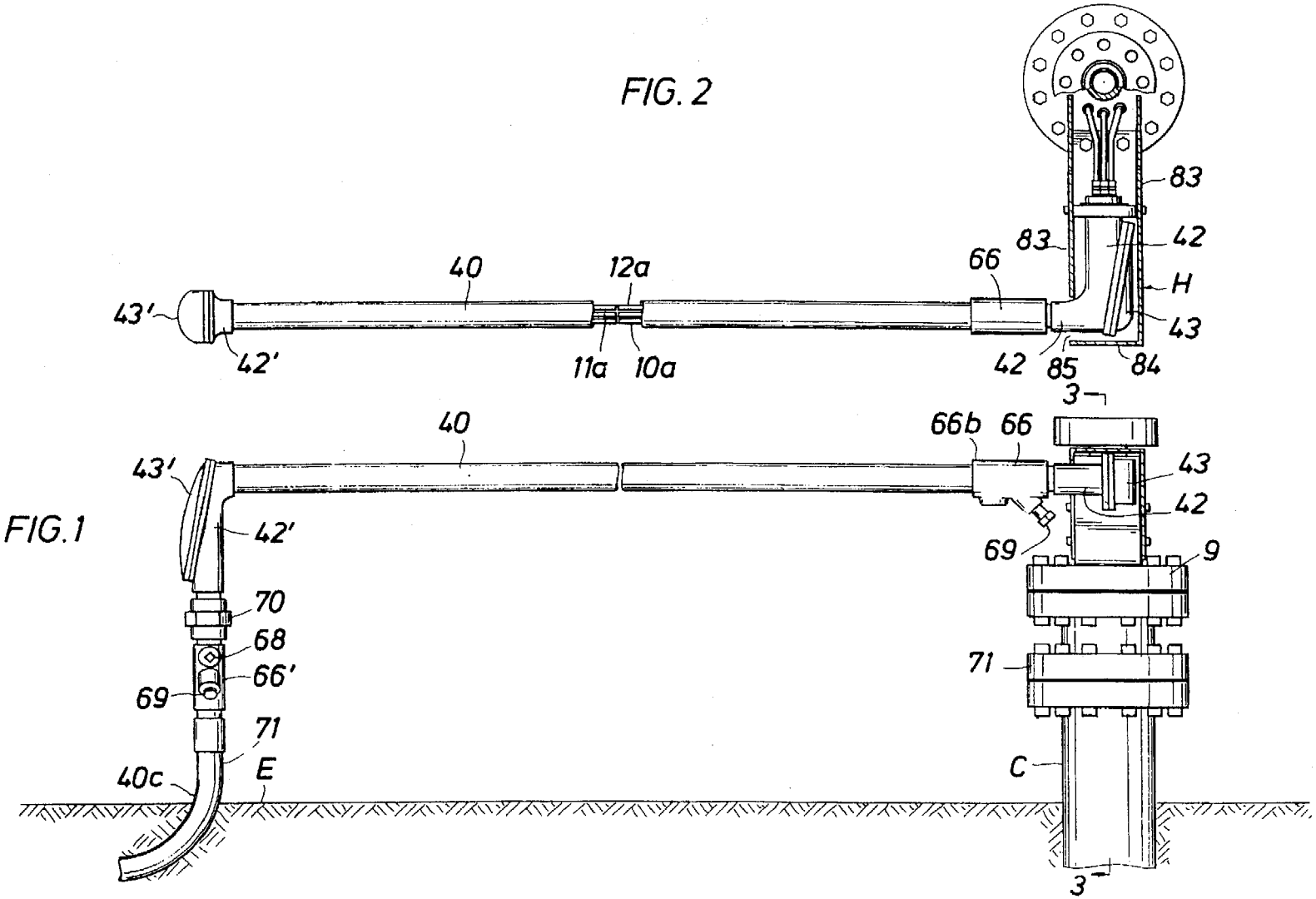
FIG. 1 is a side view of one preferred form of the present invention.
FIG. 2 is a top view looking down on FIG. 1.

Rigid conduit means or pipe formed of suitable material, preferably metal is illustrated at 40 in FIG. 1 for receiving power source electrical conductor means which extend from a suitable power source (not shown) to adjacent the wellhead in what means be termed a hazardous area adjacent the well on which the wellhead is positioned. It can be appreciated that the rigid conduit or tubular member 40 extends from what may be termed a non-hazardous area where the power source is located into the area designated hazardous adjacent or around the wellhead. The end of the rigid conduit 40 immediately adjacent the wellhead is provided with a splice fitting 42 provided with a removable cap or cover 43 for gaining access thereto to splice the electrical conductor means with the power source electrical conductor means. Where the electrical conductor means is as illustrated at 10, 11 and 12 they each will be spliced with one of the power electrical conductor means 10*a*, 11*a* and 12*a* extending from the rigid conduit 40 to the splice fitting 42. The splice fitting 42 maybe of any suitable well known and accepted type which is sold over the counter, such as the Crouse-Hinds Catalog No. LBH70.

Figure 4:
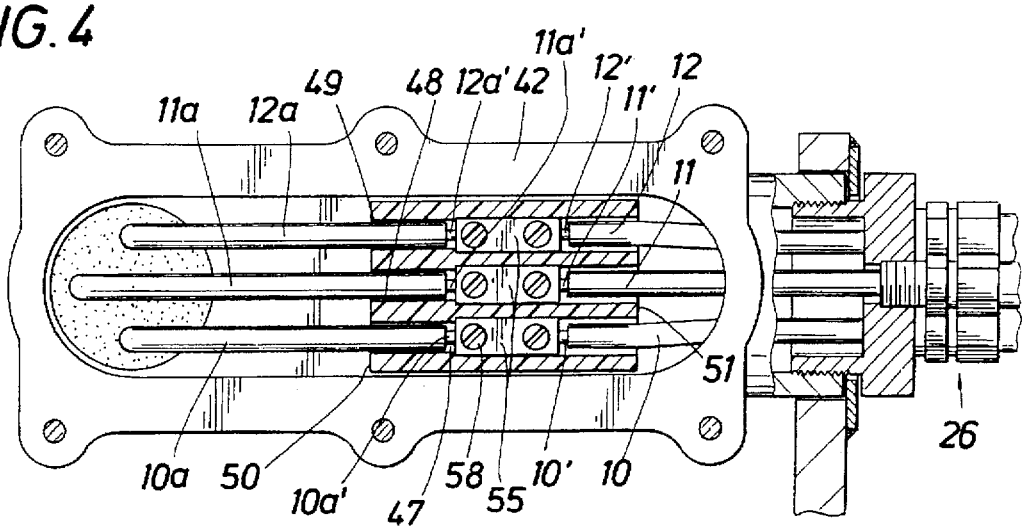
FIG. 4 is a top plan view of one form of splice fitting, with the cover removed, which may be employed to receive a formed splice which connects power source electrical conductor means with electrical conductor means in a hazardous area where the present invention is employed.
Figure 5:
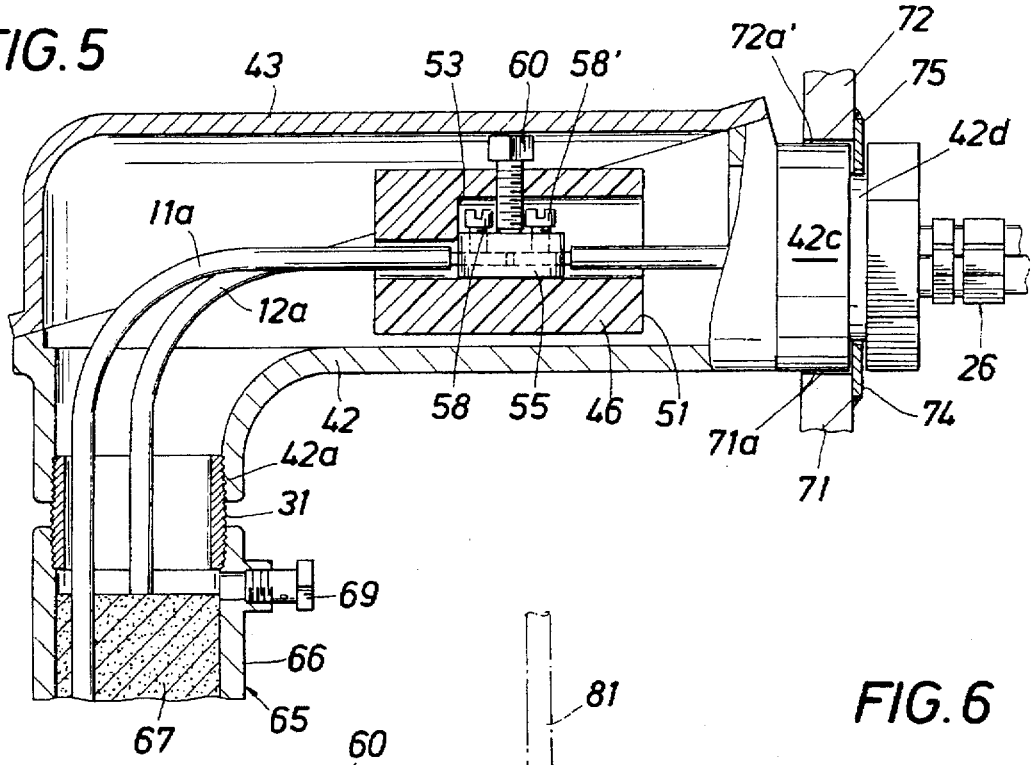
FIG. 5 is a side sectional view, partly in elevation, showing a splice completed in the splice fitting of FIG. 4 with a cover thereon.
Figure 6:
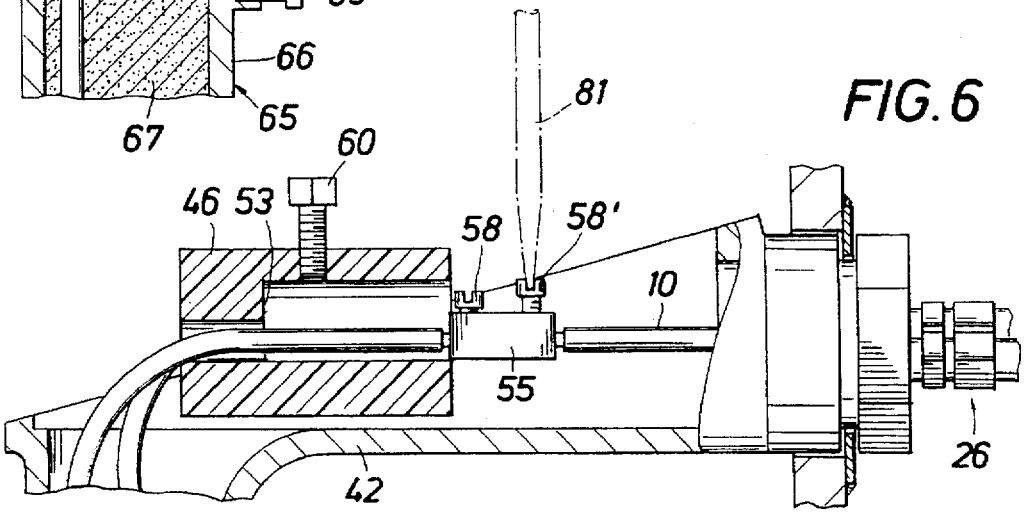
FIG. 6 is a side sectional view similar to FIG. 5 with the cap or cover of the splice fitting removed and illustrating the position of the splice before it is completed and positioned as illustrated in FIGS. 4 and 5.

Means for forming a splice is provided for positioning within the splice fitting 42 as shown in FIGS. 4–6 inclusive. Such means includes an insulating member 46 of any suitable electrical insulating material which provides as much and preferably more electrical insulation than that of the electrical insulation of the conductors to be spliced, such as delrin. Where the power source and electrical conductor means consist of separate electric conductor means, then separate passages of the same number as the electrical conductor means will be provided in insulating member 46. In the embodiment shown in FIGS. 4–6, three separate passages 47, 48 and 49 extend through the member 46 to receive 10, 11, 12 and 10*a*, 11*a*, 12*a* as shown in FIG. 4. The passages 47, 48 and 49 which extend from the one end 40 and into the member 46 are of less lateral extent than the portion of each passage which extends inwardly from the other end 51 of the member 46 as shown in FIG. 5. The junction of the enlarged passage portions extending from the end 51 with the smaller passages extending from the end 50 of the member 46 provide a shoulder 53 as shown. The passages 47, 48 and 49 communicating with the end 50 each receive therein one of the power source electrical conductor means 10*a*, 11*a*, 12*a* extending through rigid conduit means 40 from the cable that encloses them and connects with a suitable power source (not shown) as illustrated in FIG. 4. The conductor element or portion of each of the power source electrical conducting means is exposed as shown at 10*a*', 11*a*' and 12*a*' respectively. Separate splice connectors 55 are shown, each of which has a passage which extends partially from one end of each connector for receiving the exposed portions 10*a*', 11*a*' and 12*a*' of each of the power source electrical conducting means and each splice connector 55 is provided with suitable means such as a screw 58 for securing each of the exposed elements of each of the electrical conductor means in one end of the electrical conductor splice connector 55.

Similarly, the exposed conductor element portion 10', 11' and 12' of each of the electrical conductor means 10, 11 and 12 is exposed as shown in FIGS. 4 and 5 and each extends into a passage extending into the other end of each electrical conductor splice connector 55 and is secured therewith by a screw 58' or the like.

The member 46 may then be moved to a desired position within the splice fitting 42 and the cables 10, 11, 12 and 10*a*, 11*a*, 12*a* positioned so that if desired one end of the member 46 may abut the shoulder 53 as shown in FIG. 5. An insulating screw 60 formed of plastic or the like may be positioned between the two longitudinally spaced screws 58 and 58' on the center member 55 to retain the splice connectors 55 in position as desired within the insulating member 46. If desired, additional insulating screws may be positioned in member 46 to abut the end of each splice connector 55 which is adjacent the outer splice connector 55 nearest the end 51 of member 46.

To assure that the present invention will function within the hazardous area as desired, it is preferable in most instances, that a seal means represented by the numeral 65 be provided in the conduit downstream of the splice fitting 42 adjacent the wellhead in which the plural electrical conductors of the power source are spliced with the multiple electrical conductors of the down hole power cable as previously described.

The seal means 65 is downstream from the wellhead and comprises a seal fitting 66 with a sealant 67 therein. The sealant 67 is preferably and should be obtained from the manufacturer of the seal fitting. For example, in the present instance the seal fitting is catalogue No. EYD6, used as one off the shelf example of a suitable fitting which may be employed and is manufactured by Crouse-Hinds and the seal compound dr sealing means of Crouse-Hinds should be employed with that fitting. Where a seal fitting of another manufacturer is employed, then that manufacturer's seal means including its sealant compound is employed.

Particular means of Crouse-Hinds for the specific seal fitting above designated, comprises a compound and a fiber. Crouse-Hinds refers to its sealant compound as Chico A and the fiber is referred to as Chico X. To form the seal means 65, the seal fitting 66 may be provided with the sealing 67 prior to or after its connection with the nipple 31 which is connected to the end 42*a* of splice fitting 42. In either situation the Chico X fiber is stuffed in the fitting 66 and then Chico A compound is mixed with water in accordance with the manufacturer's instructions and then poured into the seal fitting on top of the fiber. The thickness, or longitudinal extent of the sealant 67 formed within a seal fitting must at least be equal in longitudinal length to the diameter of the fitting member in which it is positioned. It is recommended that the minimum diameter of the conduit or tubular member for receiving the plural electrical power conductors from the power source and various fittings employed herein have a minimum diameter of 2 inches, then the minimum longitudinal extent of the seal fitting 66 should be not less than 2 inches. As better seen in FIGS. 5 and 6, a nipple 31 is connected between the seal fitting 66 and the end 42*a* of splice fitting 42. Where the seal fitting 66 is secured in position between nipple 31 and conduit 40, the sealant 67 is formed therein by inserting Chico X and Chico A and then adding Chico A compound as described above. The seal fitting 66 includes the plug 68 and breather 69 as best illustrated in FIGS. 1 and 3 with another seal fitting 66' shown connected in the downward extension of conduit 40 outside the hazardous area as shown in FIG. 1, and the sealant may be formed by removing plug 68 and then repositioning the plug in the seal fitting after the sealant is formed in the fitting. The sealant 67 is formed within the seal fitting 66 and is within 18 inches from the adjacent splice fitting 42.

In the preferred embodiment illustrated, such female seal fitting 66 is for sealing in a vertical or a horizontal position and is preferably by way of example only, the EYD6 of Crouse-Hinds, as previously noted. It can be appreciated that other conduit seal fittings, vertical or horizontal, male and female, elbow seal, female hubs, male and female hub may be employed in certain situations.

The seal fitting 66 shown in FIG. 3 is connected at its end 66*b* to the conduit 40, and also includes a plug 68. A breather or vent 69 in the seal fitting 66 is between the sealant and the wellhead in the drawings. Seal fittings 66 and 66' are preferably the same. Seal fitting 66 is connected in the conduit 40 and then connects with splice fitting 42 which in the preferred embodiment is adjacent the wellhead in the hazardous area. Seal fitting 66' is connected in conduit 40 outside the hazardous area.

The seal means 65 including seal fitting 66, sealant 67 and breather tube or vent means 69 are for allowing an internal explosion to occur therein and in the arrangement in a hazardous situation without conveying the explosion internally of the conduit 40 or externally thereof. Also, it accommodates a flame or fire within such confinement, without permitting or conveying the flame externally. The breather vent is constructed in a well known manner to contain internal explosions and first or flames within the arrangement. In addition to the foregoing the breather tube 69 aids in discharging fluids, liquids and gases from the seal fitting 66. In this regard, it should be noted also that the sealing compound used in conduit seal fittings is somewhat porous so that gases, particularly those under slight pressure with small molecules such as hydrogen may pass slowly through the sealing compound. Also, it should be noted that there is no gasket between the splice fitting 42 and the cover 43 to permit the discharge of fluids from the splice fitting 42 to the surrounding atmosphere. If any gas or fluid should migrate through the insulation of the electrical conductors 10, 11 and 12 between the wellhead and the splice fitting, gas is permitted to escape through the conduit seal fitting 66 through the breather 69, as noted previously.

Also, the arrangement and configuration of the splice within the splice fitting 42 does not directly connect or join the two sets of cables in engagement together and thereby isolates the multiple conductors of the power cable from the plural conductors of the power source to further inhibit movement of gas and/or liguids from the well bore through the conduit 40 and the electrical conductors.

The rigid conduit means 40 may extend from the wellhead in an elevated relationship as illustrated and then the portion thereof as shown in FIG. 1 depends downwardly into the earth represented by the letter E at a location as illustrated at 40*c* in FIGS. 1 and 3 beyond the portion or area classified as hazardous. Another splice fitting 42' may be provided and a splice formed therein in the manner as described and illustrated with regard to FIGS. 4, 5 and 6 herein to connect electrical conductors from a power source with the plural electrical conductors in rigid conduit means 40. In this situation a union 88 may be threadedly connected with the end of the splice fitting 66' as indicated and also connected with the seal fitting 66' therebeneath. The seal fitting 66' is connected in turn to an elbow 71 that extends into the ground at the location outside the hazardous area. The splice fitting 42' is also preferably provided within 18 inches of splice fitting 42' as previously described with regard to splice fitting 42.

Suitable support means are provided for securing or locking the splice fitting 42 and conduit means 40 in position adjacent the wellhead and such means includes a bracket represented by the letter B with a portion 70 secured to the wellhead in any suitable manner such as by the bolt and nut means as illustrated in FIG. 3 of the drawings. The bracket B has a lower upwardly extending portion 71 and a separate upper portion 72 for connection with the lower upwardly extending portion 71. The top edge of lower portion 71 and the bottom edge of the upper portion 72 are each provided with matching semi-circular recess 71*a'*, 72*a'* to receive the end 42*c* of splice fitting 42 there through as shown in FIG. 3 of the drawings. Suitable bolts (not shown) may then be secured through the upper portion 72 to extend into the lower 71 to secure the bracket in position with the splice connected as shown in FIG. 3.

In the embodiment illustrated, suitable means as provided to lock the splice fitting 42 to or adjacent the bracket B and to the wellhead. Such means may assume any form and as illustrated includes the semi-circular rings 74 and 75 on the lower and upper upwardly extending portions 71, 72 respectively which rings project beyond the semi-circular recess defined by the mating lower and upper bracket portions 71, 72. The rings 74, 75 extend into a groove 42*d* formed in the splice fitting and thereby lock the splice fitting and bracket to the wellhead.

In another form, the securing means may be in the form of a nipple that is threaded into the end 42*c* of the splice fitting 42 and is provided with an end that is threaded externally and which projects through a circular opening in a bracket portion which extends upwardly from the portion 70 to receive the end 42*c* of the fitting therethrough. The threaded nipple end projects through the opening in the upstanding bracket portion receives a threaded ring thereon that abuts the upstanding bracket portion to secure the splice fitting 42 in position adjacent the wellhead.

In FIG. 6 any suitable instrument such as a screwdriver 81 may be employed to secure the screws 58, 58' of each of the splice connectors 55 with the respective conduit exposed ends of the plural conductors of the power cable and the multiple conductors of the down hole cable.

A suitable housing H is provided to enclose the splice fitting 42 adjacent the wellhead to inhibit fluid such as water and the like from entering thereinto. Such housing as shown in FIG. 3 includes a top wall 82, side walls 83 and an end wall 84 as shown. It will be noted that the top cover 82 of the housing H is provided with a cut away portion represented at 86 in FIG. 3 so that the housing fits snugly adjacent a portion of the spool 9 as illustrated. One of the side walls such as the wall 83 is provided with an opening 85 to enable the splice connector 42 to extend therethrough for communication with the conduit 40. The housing H is secured to the bracket B by non-tamper screws or nuts represented at 87 in dotted line. Similarly, the covers 43 for the splice fittings 42, 42' are maintained in position by non-tamper means 87 well known in the art to inhibit access, except with special tools. This effectively locks the housing H and caps 43, 43' in place so that access can be gained only by authorized personnel. The splice fitting 42' outside the hazardous area connects the horizontal portion of the conduit means 40 with the vertical portion thereof as shown, and as previously noted, a splice is formed therein in the manner as described with regard to the splice fitting 42.

The present invention is advantageous in that it provides an arrangement so that the power source electrical conducting means which supply power to the wellhead are maintained in a conduit, which conduit can be easily moved out of the way or disconnected from the wellhead when desired.

To effect such disconnection and/or removal, the splice in the splice fitting 42 immediately adjacent the wellhead is disconnected by reversing the splicing procedure previously described and the splice fitting 42 is unlocked from the bracket B. The union 88 may be rotated whereupon the conduit means 40 with the power cable therein can be rotated sufficiently to displace it from the wellhead. At the same time as the splice in fitting 42 is disconnected or thereafter, the splice in the splice fitting 42 may be disconnected and the union disconnected from the splice fitting so that the entire horizontally extending rigid conduit means 40 may be removed to a remote location while wellhead operations are conducted.

In the preferred embodiment the conduit means 40 extends from its connection with the wellhead in horizontal elevated plane or position above the earth as shown.

Where the electrical conductor means is a single large member, an offset tubing hanger may be required to accommodate passage of such conductor therethrough. Also, it can be appreciated that the conduit portion 25 may be formed by extending rigid tube means 15, or by a separate conduit portion connecting directly into the passage(s) in the barrier for communicating with the rigid tube means sealably secured therein. It can be further understood that the connector arrangement 24 can be modified to provide a single connector where the electrical conductor means is a single member. Preferably the outer jacket and any other coverings of the power source electrical conductor means should be removed so that the sealing compound, or sealant 67, in the seal fitting 66 will surround each individual insulated conductor and the outer jacket.

Figure 8:
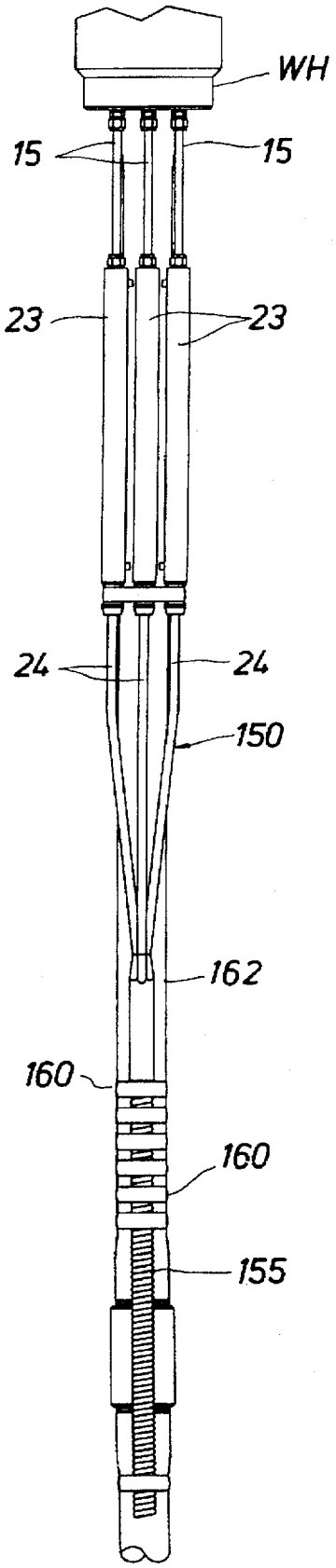
FIG. 8 is a front view of electrical connection apparatus according to the present invention within the well bore of a well.

Referring now to FIG. 8, a front view is shown of apparatus according to the present invention within the well bore below the barrier or wellhead WH. In the preferred embodiment, three similar rigid tubes 15 enclosing the electrical conductor means 10, 11, 12 connect to three similar connectors 23. The connectors 23 connect the electrical conductor means 10, 11, 12 to three separate and similar down hole cable conductors 118 (FIG. 9) extending from down hole from a pump or similar electrical apparatus requiring power. The connectors 23 connect to a triskelion 150, which is used to protect the down hole cable conductors 118, to provide column support and to provide a transition from a 3-wire cable 155 containing the three down hole cable conductors 118 to the three single cable conductor extensions 24. The triskelion 150 and the 3 wire cable 155 are banded or otherwise clamped using clamp means 160 to production tubing 162.

Figure 9:
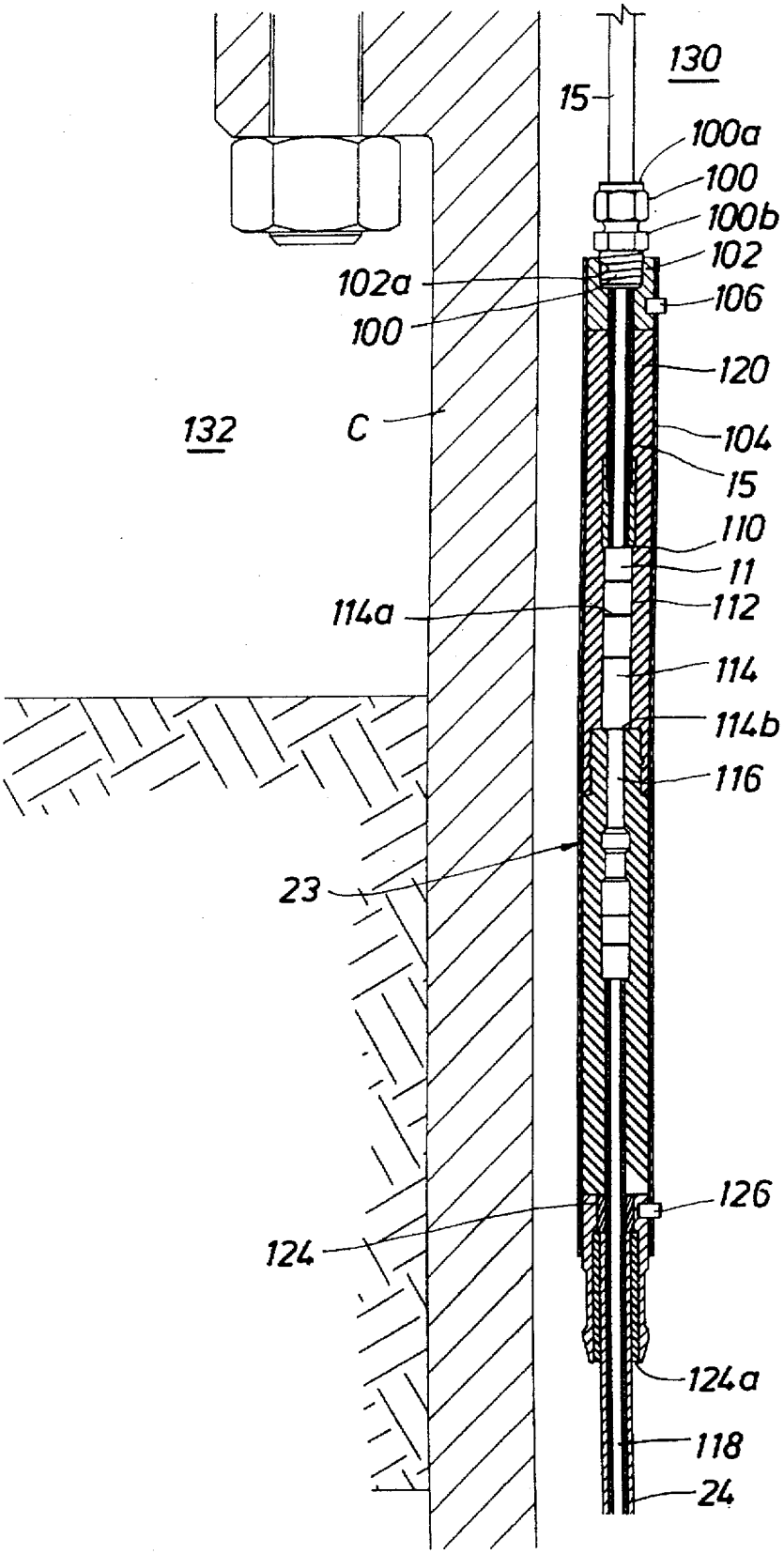
FIG. 9 is an enlarged view of connector within the well shown in FIG. 3.

Referring now to FIG. 9, an enlarged view of one of the connectors 23 is shown. Only the connection for the electrical conductor means 11 is shown and its corresponding rigid tube 15, it being understood that similar connections and apparatus are used for the electrical conductor means 10, 12, if included. The rigid tube 15 is inserted and passes through a top fitting 100 and a top stop 102. The top fitting 100 and top stop 102 are preferably made of a non-ferromagnetic, electrically conductive material, such as stainless steel, for example, or the like. The top fitting 100 is preferably a ferrule-type fitting, such as, for example, Swagelok® or the like, so that the top fitting 100 is fixedly attached to the rigid tube 15. The top fitting 100 preferably includes four parts, including an upper fitting 100*a*, a lower fitting 100*b* and a two-piece ferrule (not shown) for securing the top fitting 100 to the rigid tube 15. The lower fitting 100*b* includes a threaded extension 100*c* for interfacing a threaded hole 102*a* of the top stop 102, so that the top fitting 100 is screwed into the top stop 102. Alternatively, the lower fitting 100*b* of the top fitting 100 may be integrally formed with the top stop 102 for convenience and reduced cost.

The top fitting 100 is preferably a close fit having a relatively tight tolerance around the rigid tube 15. The top fitting 100 is preferably tightened to crimp the rigid tube 15 to preferably form a fluid seal. This choking effect of the rigid tube 15 by the top fitting 100 further prevents fluid flow from the well bore to an external low pressure area 132 through the rigid tube 15.

An outer sleeve 104, preferably comprising a hollow cylindrical tube, preferably made of a non-ferromagnetic electrically conductive material, such as stainless steel, for example, or the like, forms a protective shield circumscribing the connector 23. The outer sleeve 104 includes an upper hole 104*a* (FIG. 10) for receiving a set screw 106. The top stop 102 includes a corresponding threaded hole 102*b* for receiving the screw 106. In this manner, the outer sleeve 104 is slid around the top stop 102 so that the holes 104*a* and 102*b* are aligned, and the screw 106 is screwed into the threaded hole 102*b* through the hole 104*a* of the outer sleeve 104 and tightened to the rigid tube 15. The outer sleeve 104 is thus fixedly attached to the top stop 102, which is attached to or integrally formed with the top fitting 100.

Figure 10:
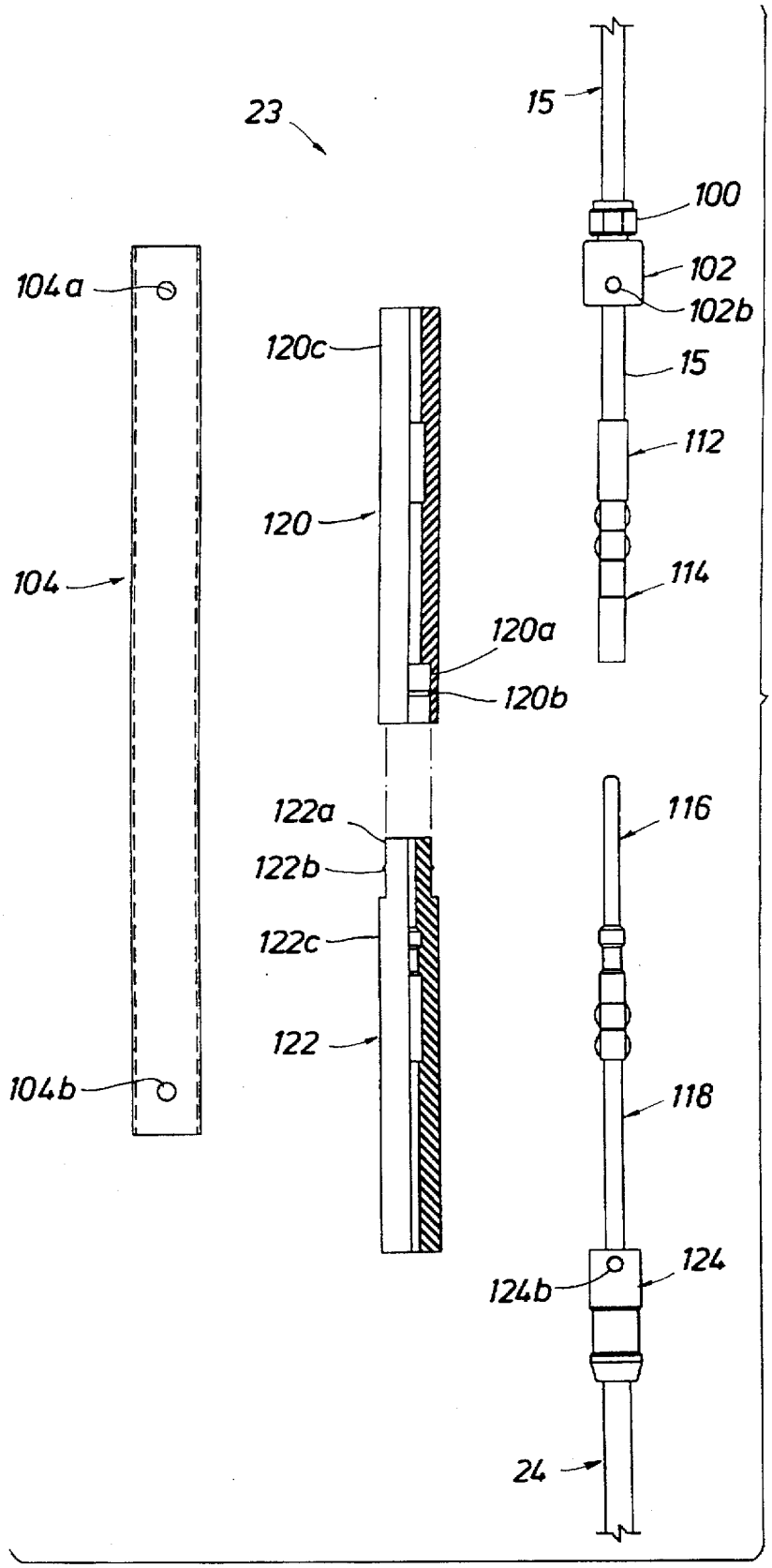
FIG. 10 is an exploded side view of the connector of FIG. 9.

FIG. 10 is an exploded side view of the connector 23, included for purposes of clarity.

The rigid tube 15 extends past the connector 23 to a lower end 110, which engages a stand off 112. The electrical conductor means 11 extends beyond the lower end 110 of the rigid tube 15 through the stand off 112 to the upper end 114*a* of a female connector socket 114. The insulation 113 (FIG. 11) of the electrical conductor means 11 is stripped off exposing the conductor element portion 11', which is crimped and/or soldered to electrically and mechanically connect it to the female connector socket 114, as known to those skilled in the art.

The female connector socket 114 includes a socket portion 114*b* at its opposing end for receiving a male connector pin 116. It is noted that the particular male and female connectors described herein could be reversed, or otherwise replaced with other slidable connector means as known, so that the present invention is not limited by any particular connector means. The male connector pin 116 and the female connector socket 114 are formed of any suitable electric conducting material such as copper, or the like, and each is formed by a plurality of longitudinally extending portions which are configured to axially align and mate. A similar connection configuration is more fully described in the U.S. Pat. No. 4,614,392, which is hereby incorporated by reference. In this manner, the male connector pin 116 and the female connector socket 114 are coupled together for electrically connecting one of the down hole cable conductors 118 to the electrical conductor means 11.

There are preferably three similar down hole cable conductors 118, although only one is referenced. The cable 118 extends upwards from the down hole pump to penetrate the connector 23, where the cable 118 is electrically and mechanically connected to the male connectcor pin 116 in a similar manner as described for the electrical conductor means 11 and the female connector socket 114.

A female boot 120, preferably comprising rubber, is formed to surround the rigid tube 15, the stand off 112 and the female connector socket 114 for electrically isolating the conducting portions from the outer sleeve 104. The female boot 120 preferably includes a longitudinal passage 120*a* and an arcuate grove 120*b* for receiving a projecting end portion 122*a* including an arcuate, annular rib 122*b* of a male boot 122. The male boot 122 is inserted into the female boot 120 and locked as shown, where the projecting end portion 122*a* fills the longitudinal passage 120*a* so that the arcuate, annular rib 122*b* interfaces the arcuate groove 120*b*. The male boot 122 also comprises rubber, and is formed to surround the cable 118 and the male connector pin 116 for electrical isolation from the outer sleeve 104. The male and female boots 120, 122 have outer surfaces 120*c*, 122*c*, respectively, which are preferably formed to fill the outer sleeve 104. The outer sleeve 104 is thus electrically isolated from the conductive portions of the connector 23.

The cable 118 extends through and past the end of the conductor extension 24 and through a bottom stop 124. The bottom stop 124 includes an opening or counter bore 124*a* for terminating the conductor extension 24. The conductor extension 24 fits reasonably tight into the counter bore 124*a* to create a relatively rigid connection between the connector 23 and the conductor extension 24. This prevents bending which could otherwise cut the insulation of the cable 118. The cable 118 extends past the bottom stop 124 to the male connector pin 116 within the connector 23. The bottom stop 124 includes a threaded hole 124*b* for receiving a threaded set screw 126. The outer sleeve 104 includes a lower hole 104*b* aligning with the threaded hole 124*b* for receiving the screw 126. In this manner, the screw 126 fastens the outer sleeve 104 to the bottom stop 124.

Although not clearly shown, a bushing is preferably inserted into the counter bore 124*a* to a position between the cable 118 and the bottom stop 124. In practice, there are about 200 different sizes of down hole cable conductors 118, although the bottom stop 124 is preferably only one size. For convenience, therefore, field personnel carry a plurality of ring-shaped bushings having a fixed external diameter to fit within the bottom stop 124, and different incremental sizes of the internal diameter to match the size of the cable 118. After insertion of the proper sized bushing, the screw 126 is tightened against the bushing to complete the connection.

In operation, the formation exerts a significant amount of pressure which may be applied against the barrier or wellhead WH. The fluid within the well bore forms a fluid column which rises and falls depending upon the formation pressure and whether the down hole pump is turned on or off. When the pump is turned off, the fluid column typically rises causing a high pressure area 130 surrounding the connector 23. This high pressure can reach the pressure rating of the wellhead WH, which could be 5,000 to 10,000 psi or more. In contrast, the surrounding air 132 outside the wellhead WH is at relatively low pressure.

Due to the high pressure, the male and female boots 120, 122 typically become saturated with well fluids. When the down hole pump is turned on, it pumps fluid up the production tubing 162 typically causing the fluid column to fall, so that the area 130 becomes relatively depressurized. The fluid impregnated male and female boots 120, 122 can not release the fluid fast enough, so that a pressure differential exists between the inside of the connector 23 and the surrounding depressurized area 130. The rubber of the male and female boots 120, 122 tends to expand to force the male and female boots 120, 122 apart, which would otherwise separate the male connector pin 116 from the female connector socket 114. Due to the top stop 102, the bottom stop 124 and the outer sleeve 104, the rubber boots 120, 122 are confined and can not readily expand so that the connector 23 remains intact. Further, since the top fitting 100 is fixedly attached to the rigid tube 15 and attached to or integrally formed with the top stop 102, the rigid tube 15 is not forced out of the connector 23, so that the connector 23 remains intact.

Figure 11:
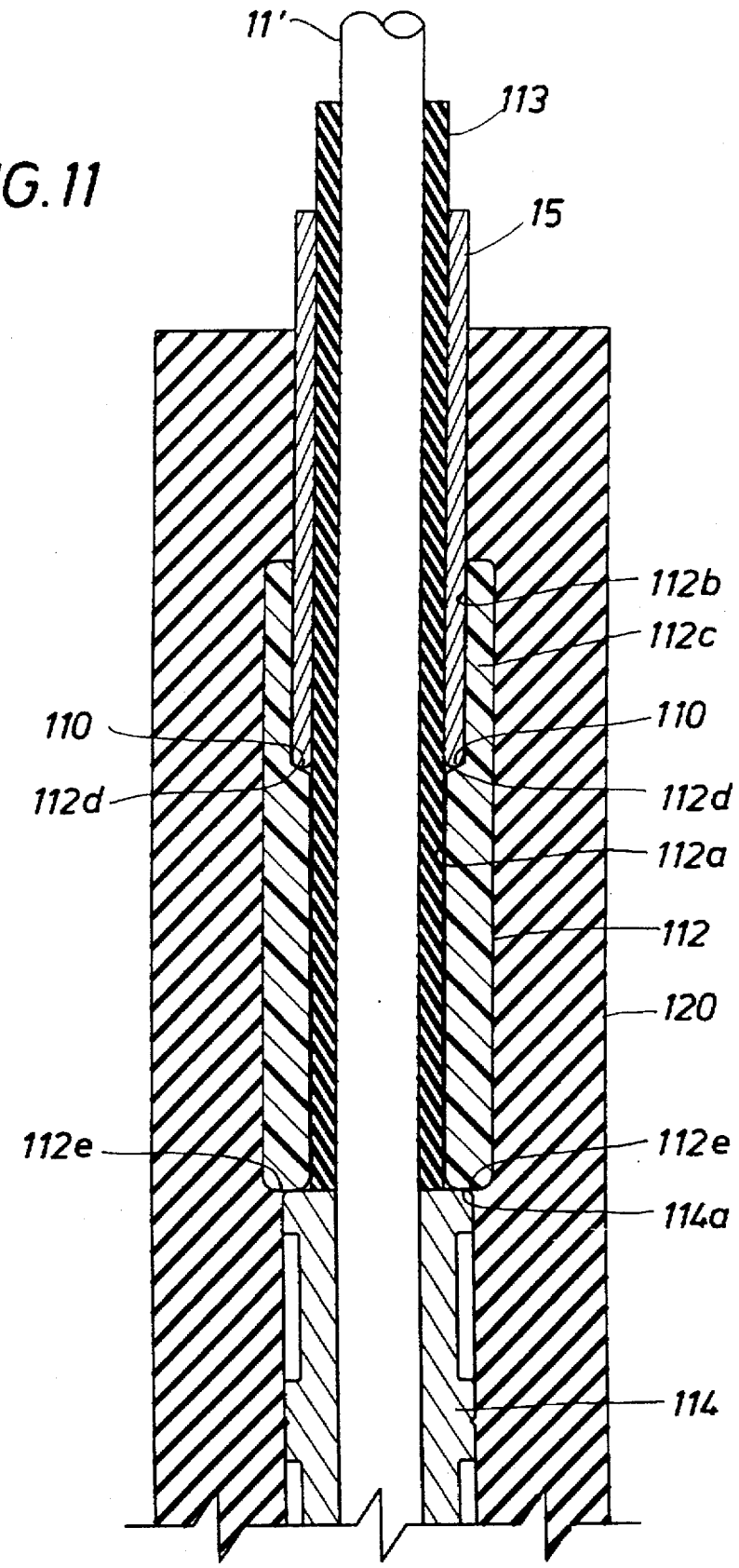
FIG. 11 is a partial sectional view illustrating a stand off according to the present invention within the connector of FIG. 9.

Referring now to FIG. 11, a partial sectional view of the connector 23 is shown illustrating the stand off 112. As shown, the stand off 112 preferably has a larger diameter than the female connector socket 114 for proper placement of the rubber female boot 120. When the down hole pump is turned off, any fluid existing in the high pressure area 130 seeps inside the connector 23 and impregnates the male and female boots 120, 122. A low pressure area exists inside the rigid tube 15 relative to the area 130 and the boots 120, 122. The pressurized fluid impregnated rubber of the boots 120, 122 tends to expand within the connector 23, thereby forming a tighter seal on all passages through which well fluids might flow. It is undesirable for fluid to escape through the rigid tube 15 via the electrical conductive means 11 comprising the conductor element portion 11' and the insulation 113.

The stand off 112 preferably formed of a reinforced, high voltage, high strength insulator material. The material is preferably a glass-filled material, such as Westinghouse G-10, for example. The stand off 112 has a hole **112*a* with a diameter for surrounding the insulation 113 of the electrical conductive means 11, and a second, larger diameter hole 112*b* on one end extending partway into the stand off 112. The second hole 112*b* is carefully counter bored to receive the rigid tube 15 to preferably create a tight fit. The second hole 112*b* also forms an extension lip 112*c* for circumscribing the rigid tube 15, and a shoulder 112*d* engaging the lower end 110 of the rigid tube 15. In spite of the high pressure, the rubber of the female boot 120 may extend slightly between the extension lip 112*c* and the rigid tube 15, but will not penetrate all the way to the shoulder 112*d*. In fact, due to the pressure applied by the surrounding rubber, and the low pressure within the rigid tube 15, the lower end 110 of the rigid tube 15 is forced into the shoulder 112*d* of the stand off 112, forming an effective fluid seal. The stand off 112 has a relatively wide flat face at a lower end 112*e* engaging the upper end 114*a*, which is also relatively wide and flat, forming a fluid seal. The pressure also forces the female connector socket 114 against the lower end 112*e* of the stand off 112. Thus, fluid will not escape past the stand off 112**, allowing for a greater seal.

It is now appreciated that each of the connectors 23 for connecting the electrical conductor means 10, 11, 12 provides an effective seal preventing fluid from escaping through the rigid tubes 15, and remain intact during pressurization and depressurization occurrences in the well. The top and bottom stops 102, 124 attached to the outer sleeve 104 confines the rubber boots 120, 122 and prevents them from expanding. The stand off 112 includes a shoulder **112*d* formed around the rigid tube 15** to prevent a fluid leak.

Time varying current through a conductive wire typically generates a magnetic field circumscribing the wire. The barrier comprising the tubing hanger 8 and flange 16 typically comprise ferromagnetic materials to achieve the required strength without excessive expense. The varying current through the electrical conductor means 10, 11, 12 would typically induce electrical eddy currents in the tubing hanger 8 and the flange 16, which is undesirable because the electrical eddy currents cause a significant loss of energy due to heating of the wellhead WH. To reduce the electrical eddy currents, multiphase conductors are typically grouped together in an attempt to cancel the induced magnetic flux from each conductor with the opposing magnetic flux from the other conductors. This grouping of the conductors, however, increases the radial profile of the electrical penetration of the wellhead WH.

Figure 12:
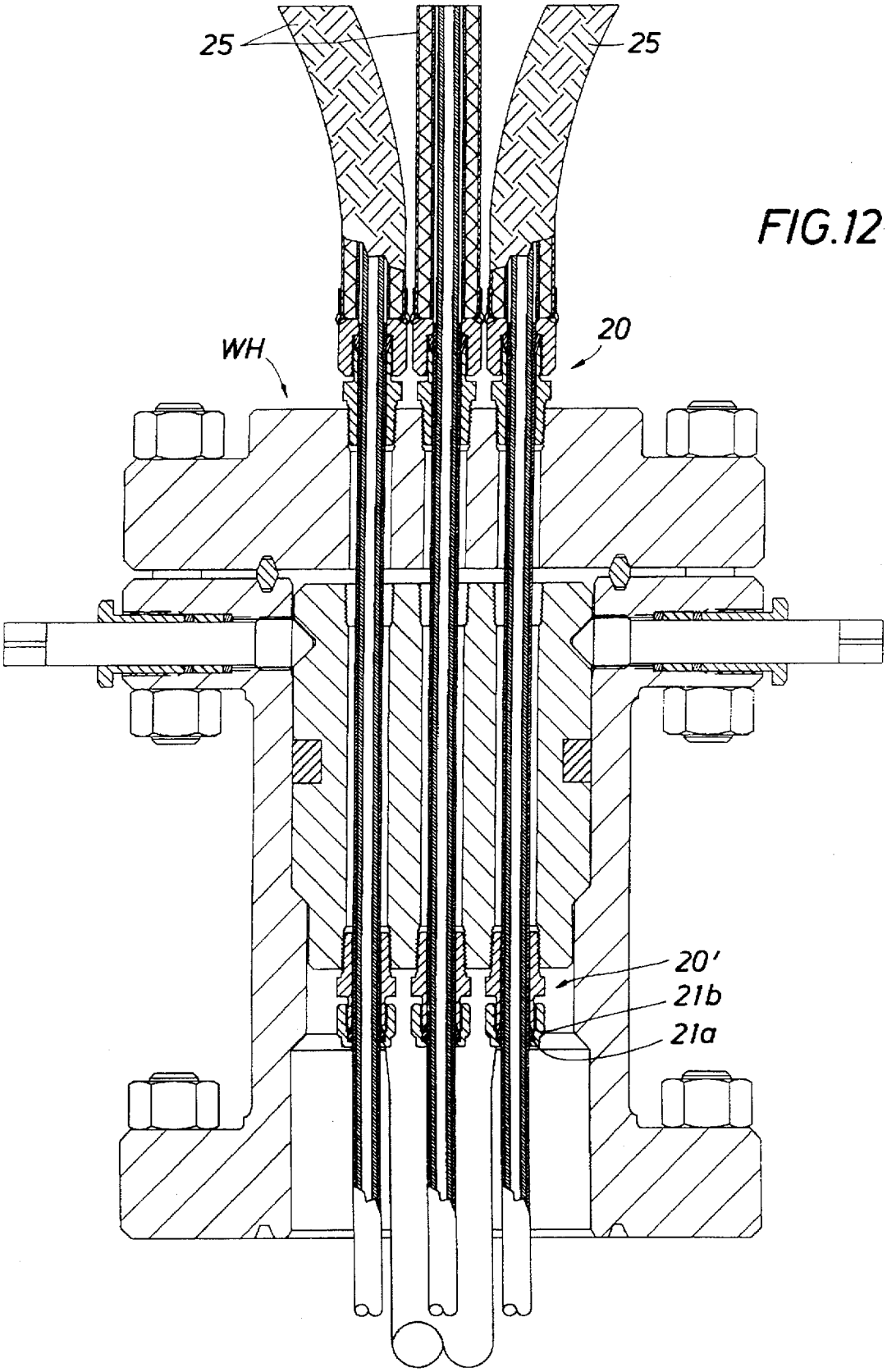
FIG. 12 is a partial sectional front view of a wellhead illustrating relative positioning according to the present invention of electrical conductors penetrating the wellhead.

Referring now to FIG. 12, a partial sectional front view of the wellhead WH is shown, illustrating the preferred positions of the electrical conduction means 10, 11, 12 penetrating the wellhead WH. From FIGS. 12 and 2, it is seen that the three rigid tubes 15 passing through the flange 16 and the tubing hanger 8 are preferably aligned side-by-side defining an arc on a circle preferably having its center located at the center of the wellhead WH, although the present invention is not limited to this particular configuration. FIG. 3 shows that the profile of all of the rigid tubes 15 are approximately that of a single rigid tube 15, which is desirable since it allows for a reduced radial profile of multiphase conductors penetrating the wellhead WH. Nonetheless, the present invention is not limited to any particular configuration of the rigid tubes 15, so that a single rigid tube 15 could be used or multiple rigid tubes 15 could be arranged in any fashion.

In spite of the fact that the electrical conductor means 10, 11, 12 are operated at high voltage to reduce amperage and consequent power losses, significant amounts of sinusoidally varying current flows through the electrical conductor means 10, 11, 12 in three phase fashion. Without the present invention, high current conductors arranged in this fashion would not cancel the magnetic flux of the conductors, causing heating of the wellhead WH and loss of energy. There has been, however, no measurable rise in the temperature of the wellhead WH, even with power demands up to 200 horsepower or more using apparatus according to the present invention. The rigid tubes 15 are preferably formed of a non-ferromagnetic electrically conductive material, such as for example, stainless steel, which effectively act as eddy current shunts, so that electrical eddy currents only flow in the rigid tubes 15. Since the currents flowing in the rigid tubes 15 do not produce any significant heat, the wellhead WH does not absorb energy nor does it generate heat. Thus, the use of the non-ferromagnetic rigid tube 15 saves energy and eliminates undesirable heating of the wellhead WH.

Figure 13:
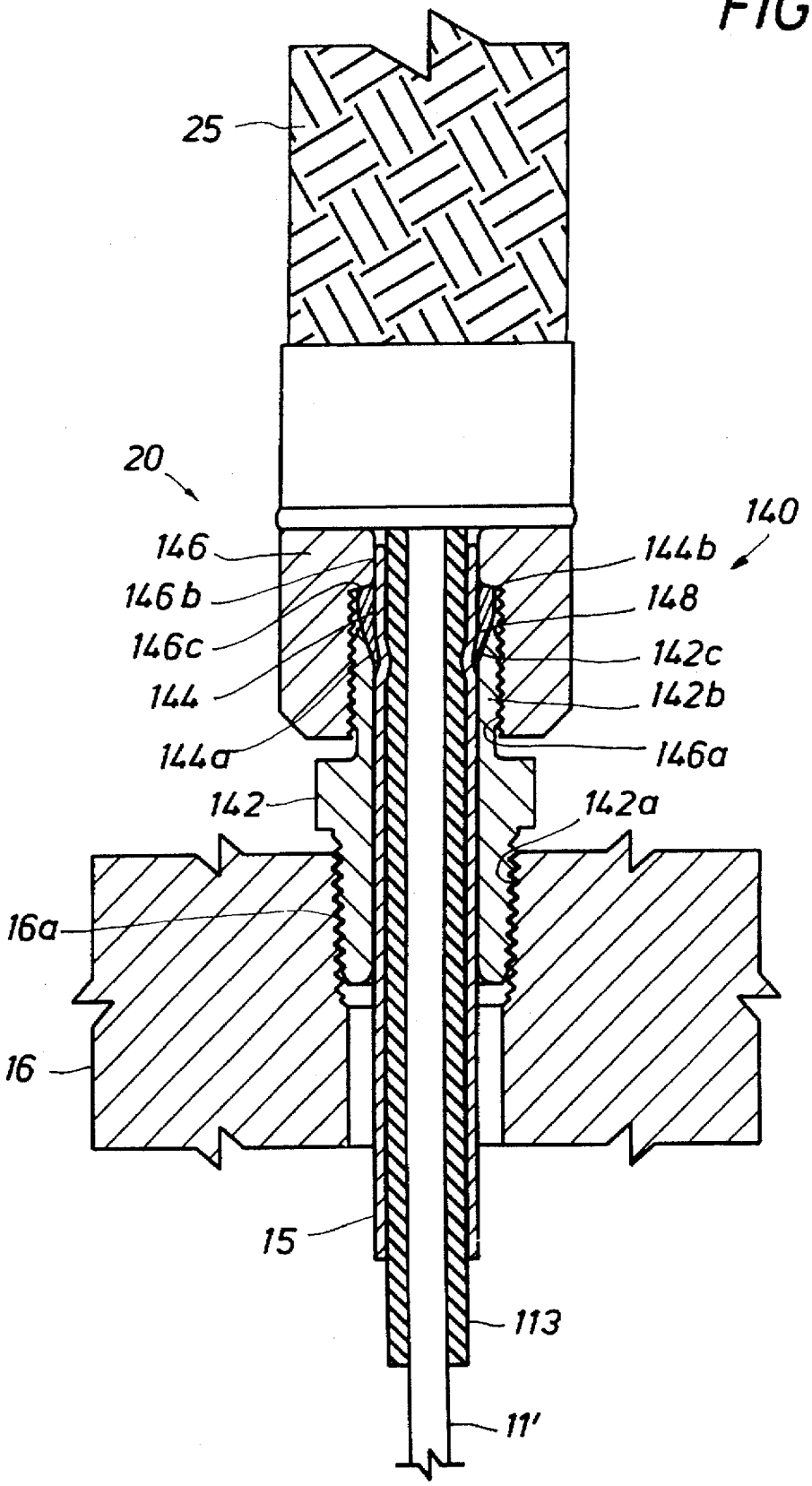
FIG. 13 is a partial sectional view of a rigid seal means for sealably securing the rigid tube within the wellhead.

Referring now to FIG. 13, a partial sectional view of the rigid seal means 20 is shown for sealably securing the rigid tube 15 to the barrier of the wellhead WH. The conduit portion 25 is preferably connected to a ferrule-type fitting 140, such as a Swagelok® or the like, used to connect the conduit portion 25 to the wellhead WH and to the rigid tubes 15. The ferrule-type fitting 140 comprises a body fitting 142 having a threaded portion **142*a* for interfacing a threaded hole 16a of the tubing spool 16, thus providing a metal to metal explosion-proof connection. The body fitting 142 slides over the rigid tube 15 and is screwed into the threaded hole 16***a*. The body fitting 142 has an upper threaded projecting member 142*b* having a conical counter bored upper end 142*c* creating a gap between the threaded projecting member 142*b* and the rigid tube 15.

A ferrule 144, preferably comprising a ring-shaped conical bushing, has a center hole for fitting around the rigid tube 15 to rest on top of the body fitting 142. The cross-section of the ferrule 144 is preferably wedged-shaped, having a wide flat portion 144*b* at one end, and an opposing narrow end 144*a* fitting into the gap between the rigid tube 15 and the body fitting 142. The ferrule 144 preferably comprises a hard moldable or machinable plastic type material, and more preferably comprises a polyimide resin, such as Vespel® by Dupont Co., which has some flexibility to retain its original shape after being deformed. Other heat resistant polymers or moldable powders could be used. Also, polyetheretherketones (PEEK), such as, for example, XYTREX® series 450 by E.G.C., Corp., could be molded or machined to form an appropriate ferrule 144. A nut fitting 146 preferably has a threaded opening 146*a* for interfacing the threaded projecting member 142*b*. The nut fitting 146 has an upper opening 146*b* for slidably fitting around the rigid tube 15. The upper opening 146*b* is narrower than the threaded opening 146*a*, forming an inner shoulder 146*c*, for contacting or interfacing with the flat portion 144*b* of the ferrule 144.

Thus, when the nut fitting 146 is screwed onto the body fitting 142 and over the ferrule 144, the shoulder 146*c* presses against the ferrule 144, wedging the ferrule 144 further into the gap. Due to the cross-sectional wedge shape of the stand off 112 ferrule 144, it slides against the counter bored upper end 142*c*, deforming to press against the rigid tube 15. The ferrule 144 is preferably deformed slightly as the nut fitting 146 is tightened, causing a slight deformation or crimp 148 in the rigid tube 15. The ferrule 144 thus preferably allows a tight connection between the body and nut fittings 142, 146. However, the ferrule 144 is made of a softer material than the material of the rigid tube 15, so that the ferrule 144 does not "bite" into the rigid tube 15. The crimp 148 in the rigid tube 15 pinches or chokes the electrical conductor means 11 to form a fluid seal for preventing any fluid from leaking from the high pressure area 130 inside the wellhead WH through the rigid tube 15.

When the nut and body fittings 142, 146 are subsequently removed, the ferrule 144 retains its original shape and can thus be easily removed from the rigid tube 15. In prior designs, a metal ferrule was used, which permanently bit and clamped to the rigid tube 15 when the fitting was screwed together. When the well was pulled, the metal ferrule had to be sawed off or otherwise removed, thereby destroying the rigid tube 15. The ferrule 144 according to the present invention, on the other hand, allows easy removal when the well is pulled. Recall that a similar rigid seal means 20' is provided on the opposite end of the tubing hanger 8, forming a seal on either end of the wellhead WH. As shown in FIG. 12, however, the lower rigid seal means preferably includes a standard two-piece metal ferrule to lock the rigid tube 15 in place, preventing axial movement. A ring-shaped ferrule 21*a* is forced against a conical shaped ferrule 21*b* to form a metal to metal contact as known to those skilled in the art. The upper rigid seal means 20 using the single ferrule 144 does not necessarily function as an axial stop.

Figure 14:
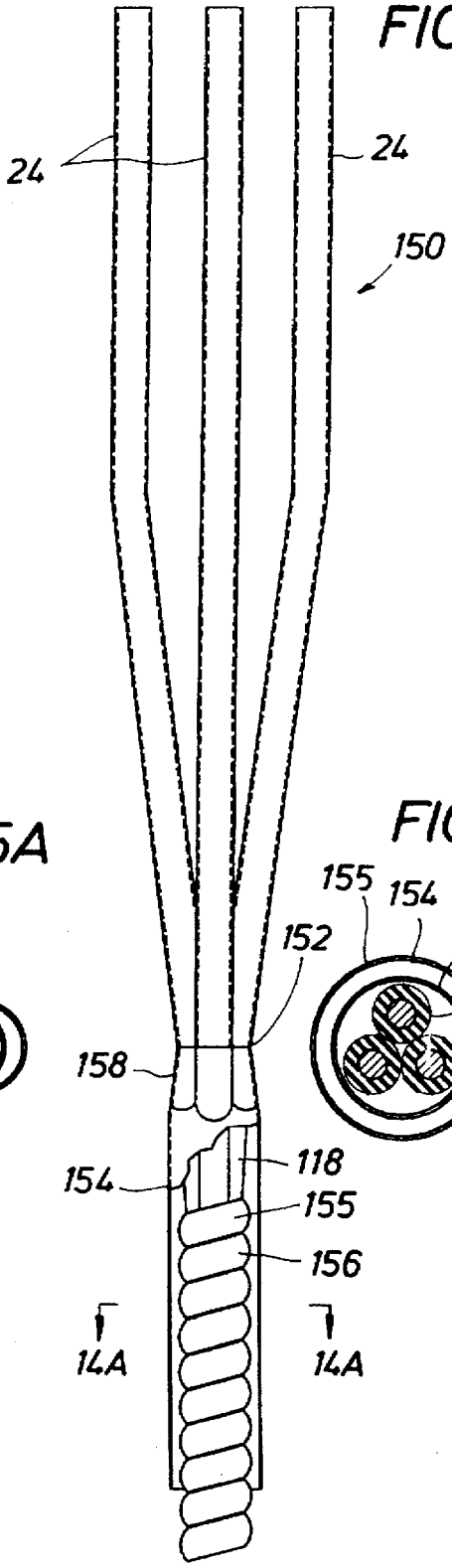
FIGS. 14 and 14A are sectional views of a triskelion according to the present invention for protecting down hole cables.

Referring now to FIG. 14, a partial sectional view is shown of a protective cover or sheath, otherwise referred to as the triskelion 150, which protects and separates the individual conductors and also covers the end of the insulation of the down hole cable conductors 118. The triskelion 150 is preferably formed from a non-ferromagnetic electrically conductive material, such as nickel-plated brass or stainless steel, for example, although other similar materials may be used. As described previously, three down hole cable conductors 118 are extended within corresponding rigid tube means forming conductor extensions 24. The conductor extension 24 fits relatively snugly around the down hole cable conductors 118 forming a relatively small annular clearance to prevent excessive expansion of the insulation of the down hole cable conductors 118 during depressurization. The upper ends of the conductor extensions 24 are terminated at the counter bores 124*a* as described previously.

The conductor extensions 24 are separated near the top of the triskelion 150, but are integrally formed at a mid-point 152 with a single, larger protective sheathing 154, so that the down hole cable conductors 118 extend into the sheathing 154. The down hole cable conductors 118 are grouped together within the sheathing 154 forming the 3-wire cable 155 bound by protective armor 156, which preferably comprises corrugated steel armor surrounding the down hole cable conductors 118. The 3-wire cable 155 and the protective armor 156 extends all the way down the bore hole to protect the down hole cable conductors 118. The sheathing 154 is preferably flared below the mid point 152 at a location 158, to increase the diameter of the sheathing 154 to cover the grouped down hole cable conductors 118 and the protective cover 156. The triskelion 150, therefore, covers the end of the cable insulation of the cable 118 and separates the individual down hole cable conductors 118.

It is known that the insulation surrounding the cable conductors 118 saturates with fluid, so that the insulation tends to expand and contract during compression and decompression when the down hole pump is turned on and off. In this manner, the triskelion 150 prevents damage of the conductors and surrounding insulation of the down hole cable conductors 118, by preventing the insulation from expanding after decompression. Such expansion could destroy the insulation around the conductors, possibly causing an electrical short. The triskelion 150 further provides a transition from the 3-wire cable 155 down hole surrounded by the protective armour 156 to the three single cable conductor extensions 24. The triskelion 150 is axially fixed in position by the clamp means 160 to provide axial column strength to the conductors to maintain vertical elevation of the male connector pin 116 inside the female connector socket 114.

Figure 15:
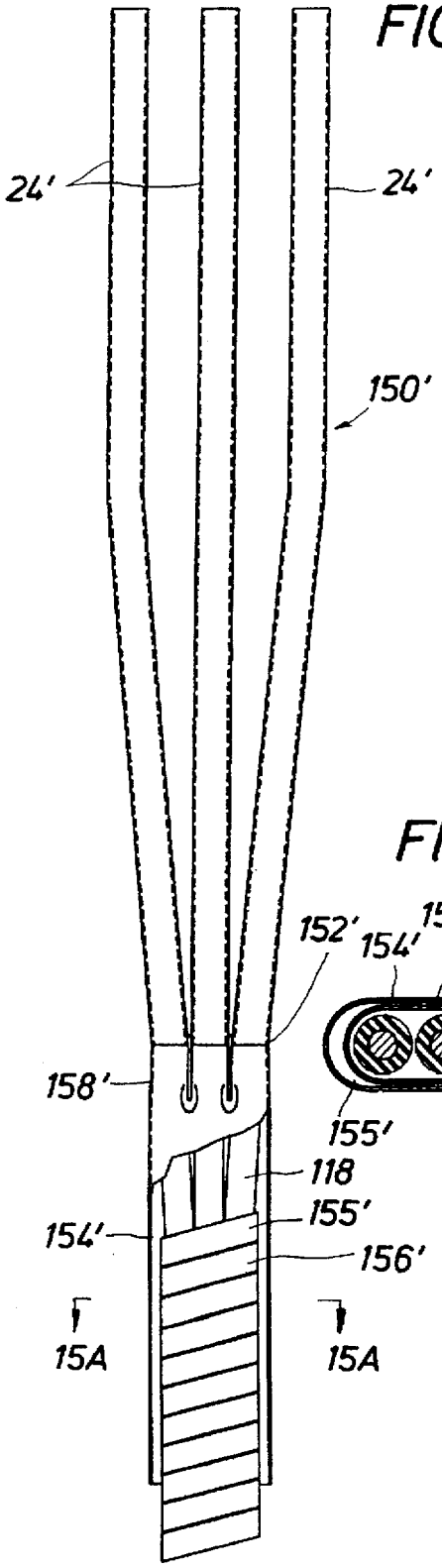
FIGS. 15 and 15A are sectional views of an alternative embodiment of the triskelion of FIG. 14.
Figure 15A:
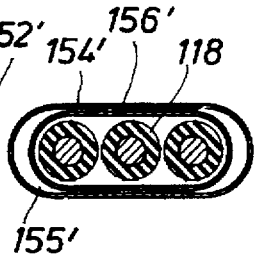
Figure 14A:
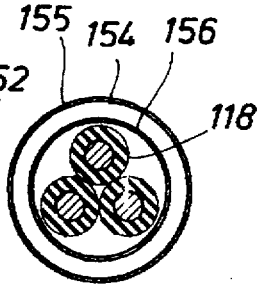

FIG. 14A is a cross-sectional view of the triskelion 150 looking along line 14A—14A of FIG. 14. FIGS. 15 and 15A illustrate an alternative triskelion 150', where the down hole cable conductors 118 are preferably aligned side-by-side. Analogous parts are indicated using identical reference numerals followed by an apostrophe symbol "'". One advantage of the triskelion 150' over the triskelion 150 is that the triskelion 150' has a narrower profile for flat cables.

Referring now to FIG. 16, a top plan view of an alternate form of splice fitting, referred to as the splice fitting 200, is shown with a similar removable cap or cover 202 (FIG. 17) removed. The splice fitting 200 and its corresponding cover 202 are similar and used for similar purposes as the splice fitting 42 and cover 43. It has been discovered that an appreciable amount of water collects within the splice fittings 42 or 200 due to condensation or other means, so that it is desirable to protect the electrical connection from water. However, if the seal through the barrier of the wellhead WH should fail for any reason, such that well fluids travel from the well bore through the electrical conductor means 10, 11, 12 to the splice fitting 200, it is desired to prevent the fluids from reaching and penetrating the power electrical conductor means 10*a*, 11*a* and 12*a*. If this were to occur, there is an increased likelihood that the well fluids could reach a non-hazardous area via the power electrical conductor means 10*a*, 11*a*, 12*a*.

The electrical conductor means 10, 11, 12 enter the splice fitting 200 from the wellhead WH into openings 204 of breather boots 206. The splice fitting 200 includes one or more similar electrical connections depending on the number of electrical conductor connections required, where there are three connections in the preferred embodiment. The conductor element portions 10', 11' and 12' are exposed within the openings 204, and are inserted through gas block seal passages 208 and into corresponding passages 210 of separate splice connectors 212. The splice connectors 212 preferably comprise an electrically conductive material such as copper or the like. The breather boots 206 include cavities 214 for placement of the splice connectors 212. The power electrical conductor means 10*a*, 11*a*, 12*a* enter the opposing or power side end of the splice fitting 200 into power conductor passages 216 of the breather boots 206. The power conductor element portions 10*a*', 11*a*' and 12*a*' of the power electrical conductor means los, 11*a* and 12*a*, respectively, are exposed and inserted into corresponding passages 218 on the opposite side of the splice connectors 212.

Referring now to FIG. 17, a sectional side view of the splice fitting 200 is shown with the cover 202 attached. Only the connection for the electrical conductor means 10*a* and 10 is shown, it being understood that the connections for the other electrical conductor means 11*a*, 12*a* and 11, 12 are made in a similar manner. Two threaded holes 220 and corresponding screws 222, preferably allen-type screws, are provided for securing the conductor element portion 10' to the splice connector 212. In a similar manner, two threaded holes 224 and corresponding screws 226, preferably allen-type screws, are provided for securing the power conductor element portion 10*a*' to the splice connector 212.

The breather boot 206 preferably comprises rubber, or any other suitable material for providing electrical insulation and to seal the electrical connection from penetration by water. The breather passage 204, however, includes a breather passage 205 along the electrical conductor means 10, which would otherwise allow fluid communication within the breather boot 206. Furthermore, the insulation 113 of the electrical conductor means 10 does not extend into the opening 204 all the way to the gas block seal passage 208, leaving a header space 228 between the insulation of the electrical conductor means 10 and the gas block seal passage 208. The purpose of the breather passage 205 and the gas block seal passage 208 will be described below.

Referring now to FIG. 18, a sectional side view of the splice fitting 200 is shown illustrating the position of the splice fitting 200 to make the electrical connection. The breather boot 206 is preferably slid onto the electrical conductor means 10, exposing the splice connector 212. Any suitable instrument, such as an allen wrench or driver 230, may be employed to secure the screws 222, 226 of the splice connector 212 to complete the electrical connection. The breather boot 206 is slid back into place as shown in FIGS. 16 and 17, and the breather passage 204, as well as the header space 228, are filled with a silicone compound or the like, to seal the connection from water penetration. The silicone compound preferably has a grease-like viscosity to protect against water vapor. Furthermore, the silicone compound preferably has a relatively low viscosity for silicone, but high temperature viscosity stability to remain at a relatively low to medium viscosity at temperatures of about 200° F. Also, the silicone compound preferably has a high dielectric strength to achieve good electrical insulation.

Under normal conditions, the silicone compound remains in the header space 228 and the breather passage 205 until the electrical connection is removed or otherwise taken apart. However, if the seal within the bore hole should fail, so that well fluids escape through the electrical conductor mean 10 to the splice fitting 200, down hole pressure is exerted to remove the silicone compound from the header space 228 and the breather passage 205. The silicone compound functionally cooperates with the breather boot 206, so that the silicone compound is displaced by well fluids from the well via the electrical conductive means 10 at a lower pressure than that required to penetrate the gas block seal passage 208 to, and around the splice connector 212, and to the power electrical conductor means 10*a* within the breather boot 206. This allows the well fluid to escape into the splice fitting 200. As described for the splice fitting 42, there is no gasket between the splice fitting 200 and the cover 202 to permit the discharge of well fluids to the surrounding atmosphere. Thus, the well fluids are not communicated to the power electrical conductor means 10*a*, which could otherwise communicate the well fluids to a non-hazardous area.

Figure 19:
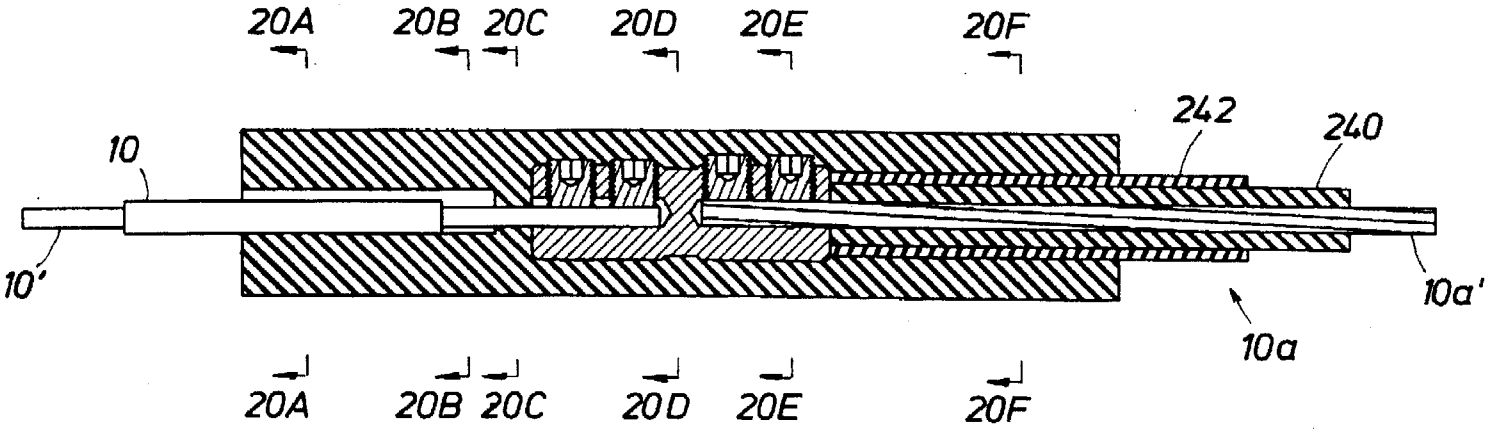
FIG. 19 is a more detailed partial cross-sectional and reversed view of the electrical connection of FIG. 17.

FIG. 19 is a more detailed partial cross-sectional and reversed view of an electrical connection within a breather boot 206.

Figures 20A, 20B, 20C, 20D, 20E, 20F:
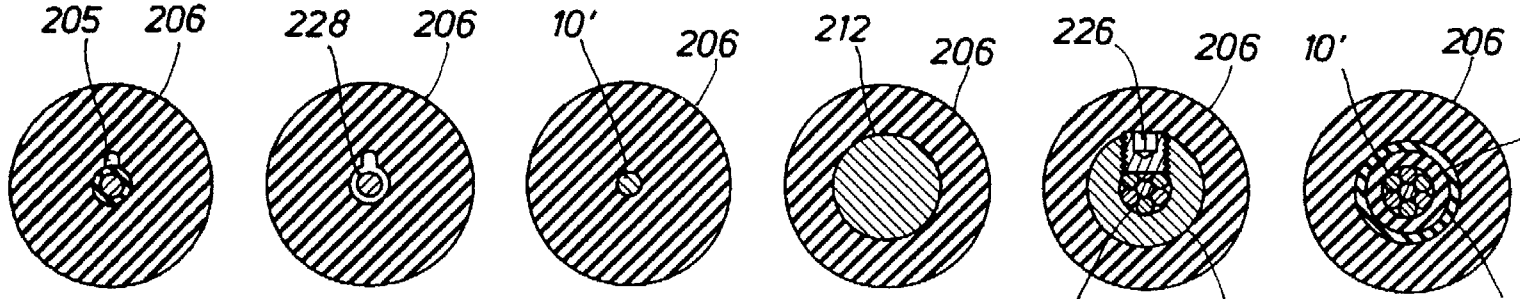
FIGS. 20A–20F are cross-sectional views of the electrical connection within the breather boots of FIGS. 16–18 looking along lines 20A—20A, 20B—20B, 20C—20C, 20D—20D, 20E—20E and 20F—20F, respectively, of FIG. 19.

FIGS. 20A–20F are cross-sectional views of the electrical connection of FIG. 19, looking along lines 20A—20A, 20B—20B, 20C—20C, 20D—20D, 20E—20E and 20F—20F, respectively. FIG. 20A illustrates the breather passage 205 more clearly. FIG. 20B illustrates the header space 228. FIG. 20C illustrates that the gas block seal passage 208 surrounds and seals the electrical conductor portion 10'. FIG. 20D illustrates the physical isolation between the power conductor element portion 10*a*' and the conductor element portion 10' within the splice connector 212. FIG. 20E illustrates the screws 226 screwed into the splice connector 212 to secure the power conductor element portion 10*a*'. In a similar manner, the screws 222 are used to secure the conductor element portion 10' to the splice connectors 212. FIG. 20E illustrates the power electrical conductor means 10*a* entering and sealed by the breather boot 206. It is noted that the power electrical conductor means 10*a* is preferably a Underwriter's Laboratories (UL) listed 5 KV stranded wire with insulation 240 circumscribed by a jacket 242, although it is not limited to any particular type of conductor.

The foregoing disclosure and description of the invention are illustrative and explanatory thereof, and various changes in size, shape and materials as well as in the details of the illustrated construction may be made without departing from the spirit of the invention.

What is claimed is:

1. A protective sheath for protecting and separating a plurality of insulated cable conductors from a single cable that includes a layer of protective armor surrounding all the conductors extending from down hole along production tubing in an underground well, wherein the protective armor terminates at a separating point of the cable conductors so that the plurality of cable conductors are separated into individual cable conductors, said sheath comprising:

a hollow rigid tube for enclosing the plurality of insulated cable conductors and protective armor; and a plurality of individual rigid tubes integrally formed to and enclosing one end of said rigid tube so that each one of the plurality of cable conductors is routed into a separate rigid tube wherein each one of said plurality of rigid tubes encloses a corresponding one of the individual cable conductors;

the rigid tube and individual rigid tubes being sized to confine but not sealingly engage the conductors when the well is pressurized for preventing excessive expansion of the insulation on the conductors during well depressurization.

2. The sheath of claim 1, wherein said hollow rigid tube and said plurality of individual rigid tubes comprise a non-ferro magnetic electrically conductive material.

3. The sheath of claim 1, wherein said hollow rigid tube and said plurality of rigid tubes are formed of nickel plated brass.

4. The sheath of claim 1, further comprising:

means for attaching the sheath to the production tubing.

* * * * *